US011783730B2

(12) United States Patent
Havonen et al.

(10) Patent No.: US 11,783,730 B2
(45) Date of Patent: Oct. 10, 2023

(54) LINERLESS LABEL

(71) Applicant: UPM Raflatac Oy, Tampere (FI)

(72) Inventors: Markku Havonen, Wroclaw (PL); Pawel Kosowski, Lubnów (PL)

(73) Assignee: UPM RAFLATAC OY, Tampere (FI)

( * ) Notice: Subject to any disclaimer, the term of this patent is extended or adjusted under 35 U.S.C. 154(b) by 0 days.

(21) Appl. No.: 17/553,932

(22) Filed: Dec. 17, 2021

(65) Prior Publication Data

US 2022/0208026 A1 Jun. 30, 2022

(30) Foreign Application Priority Data

Dec. 30, 2020 (EP) ..... 20217744

(51) Int. Cl.

| | |
|---|---|
| ***G09F 3/02*** | (2006.01) |
| ***G09F 3/10*** | (2006.01) |
| ***B05D 5/10*** | (2006.01) |

(52) U.S. Cl.

CPC ..... *G09F 3/02* (2013.01); *B05D 5/10* (2013.01); *G09F 3/10* (2013.01); *B05D 2502/00* (2013.01); *G09F 2003/0229* (2013.01); *G09F 2003/0241* (2013.01); *G09F 2003/0258* (2013.01)

(58) Field of Classification Search

CPC ..... G09F 3/02; G09F 3/10; G09F 2003/0229; G09F 2003/0241; G09F 2003/0258; B05D 5/10; B05D 2502/00; B31D 1/021

See application file for complete search history.

(56) References Cited

U.S. PATENT DOCUMENTS

| | | | | |
|---|---|---|---|---|
| 5,661,099 | A | 8/1997 | Mitchell, Jr. | |
| 5,674,626 | A * | 10/1997 | Khatib | G09F 3/10 428/447 |
| 5,725,320 | A | 5/1998 | Austin et al. | |
| 6,585,437 | B1 | 7/2003 | Wiklof et al. | |
| 6,830,795 | B1 | 12/2004 | Downs | |
| 6,890,112 | B2 | 5/2005 | Kline | |
| 8,537,184 | B2 | 9/2013 | Roth et al. | |

(Continued)

FOREIGN PATENT DOCUMENTS

| | | | |
|---|---|---|---|
| CN | 111986555 | A | 11/2020 |
| DE | 2906284 | A1 | 8/1980 |

(Continued)

*Primary Examiner* — Patricia L. Nordmeyer

(74) *Attorney, Agent, or Firm* — CANTOR COLBURN LLP

(57) ABSTRACT

This invention relates to a method for manufacturing a continuous linerless label web. The continuous linerless label web comprises a positionally alternating adhesive coating on a face. The method comprises: supplying the face with a release coating arranged on a first side, providing positionally alternating continuous adhesive stripes on a second side wherein predetermined properties of the positionally alternating continuous adhesive stripes are selected so that number of stripes in each single customer roll is one or more, width of each stripe is smaller than width of single customer roll, and positional frequency is selected so that one oscillation cycle covers 0.1-10 peripherical lengths in a machine roll, and 1-100 peripherical lengths in a customer roll defined as peripheries of full rolls. This invention further relates to a linerless label web and a linerless customer roll.

20 Claims, 12 Drawing Sheets

(56) References Cited

U.S. PATENT DOCUMENTS

| | | | | |
|---|---|---|---|---|
| 8,711,190 | B2 * | 4/2014 | Roth | B05D 5/00 347/171 |
| 9,403,392 | B2 * | 8/2016 | Roth | H04W 72/27 |
| 10,217,384 | B2 * | 2/2019 | Roth | B41M 3/006 |
| 11,224,043 | B1 * | 1/2022 | Roth | H04W 72/0466 |
| 2005/0255298 | A1 | 11/2005 | Crum | |
| 2006/0216451 | A1 | 9/2006 | Weiner et al. | |
| 2007/0267146 | A1 | 11/2007 | Vigunas et al. | |
| 2010/0015374 | A1 | 1/2010 | Fulwiler | |

FOREIGN PATENT DOCUMENTS

| | | | |
|---|---|---|---|
| DE | 202004018325 | U1 | 3/2005 |
| EP | 1407994 | A1 | 4/2004 |
| EP | 1577860 | B1 | 9/2010 |
| EP | 2551838 | A1 | 1/2013 |
| GB | 2345685 | | 7/2000 |
| JP | H09106250 | A | 4/1997 |
| JP | 2003003134 | A | 1/2003 |
| JP | 2007171776 | A | 7/2007 |
| JP | 2013011647 | A | 1/2013 |
| WO | 9631861 | A1 | 10/1996 |
| WO | 9917906 | A1 | 4/1999 |
| WO | 2009126328 | A2 | 10/2009 |
| WO | 2016012652 | A1 | 1/2016 |

* cited by examiner

LINERLESS LABEL

CROSS REFERENCE TO RELATED APPLICATION

This application claims priority to and the benefit of European Patent Application No. 20217744.0, filed on Dec. 30, 2020, the contents of which is incorporated by reference herein in its entirety.

TECHNICAL FIELD

This specification relates to a method for manufacturing a linerless label web comprising a pressure sensitive adhesive. This specification further relates to a linerless label web comprising a pressure sensitive adhesive.

BACKGROUND

In industry, a large variety of linerless labels is manufactured. Linerless labels may be used for several purposes, such as for on-demand printing. However, conventional linerless labels are known to have caused some problems. These problems may arise from the pressure sensitive adhesive being exposed without protective release liner and thus causing sticky adhesive contamination, for example, onto internal mechanisms of printers. Further, coating of adhesives with high web speeds presents some manufacturing challenges.

Thus, there is a need for an improved linerless label product, and an improved method for manufacturing label products. A successful production of linerless labels requires successful and speedy production of larger machine rolls which later on can be unwound and slit into narrower and smaller customer rolls usable in various linerless label printing devices.

SUMMARY

It is an aim of this specification to provide a method for manufacturing a linerless label comprising pressure sensitive adhesive. Further, it is an aim of the specification to provide a linerless label comprising pressure sensitive adhesive.

Aspects of the invention are characterized by what is stated in the independent claims. Preferred embodiments are disclosed in the dependent claims. These and other embodiments are disclosed in the description and figures.

The linerless label comprises a face having a first side and a second side. The first side of the face can be the top side of the face, and the second side of the face can be the bottom side of the face.

Further, a first side of the linerless label can be the top side of the linerless label, and a second side of the linerless label can be the bottom side of the linerless label.

The second side can comprise a pressure sensitive adhesive coating. The first side may comprise, e.g. a release coating. The first side may have a printable surface. In an example, the linerless label comprises a direct thermal printable coating on the first side.

The linerless label web may comprise or consist of

- the face,
- the release coating on the first side of the face, and
- the pressure sensitive adhesive coating comprising at least one positionally alternating adhesive stripe.

The linerless label web may be in a form of a machine roll. The machine roll may be unwound and slit into smaller customer rolls. A linerless label web may also be called as a continuous linerless label web.

The linerless label web can be arranged to be self-wound into a linerless machine roll, which machine roll can later be arranged to be unwound and lengthwise slit and cut into narrower customer web lengths having a predetermined length and width. Said customer web lengths can be further arranged to be self-wound into a number of linerless customer rolls. The linerless label web comprises a positionally alternating adhesive coating on the second side.

Thanks to the novel solution, a linerless label web comprising pressure sensitive adhesive coating comprising one or more in a predetermined manner positionally alternating adhesive stripes and adhesion-free areas on the second side of the face can be obtained. This allows the linerless label web to be self-wound into a larger machine rolls without suffering from telescoping effect which would significantly complicate or even prevent later unwounding and lengthwise slitting into narrower customer rolls. The invention further provides significant benefits for the smaller customer rolls.

The linerless label web may comprise at least one positionally alternating adhesive stripe per each customer roll. Thus, the machine roll may comprise at least one positionally alternating adhesive stripe per each customer roll to be obtained from the machine roll.

The method for manufacturing the continuous linerless label web may comprise the following steps:

- supplying the face with a release coating arranged on the first side,
- providing positionally alternating continuous adhesive stripes on the second side of the web with
  - predetermined number of the stripes (A) in cross-direction of the web,
  - predetermined width of the stripes (B) in the cross-direction of the web,
  - predetermined positional frequency (C) of the stripes in the lengthwise direction of the web, and
  - predetermined positional amplitude (D) of the stripes in the cross-direction of the web.

Said predetermined properties (A,B,C,D) of the positionally alternating continuous adhesive stripes can be selected so that

- number of the stripes in each single customer roll is one or more,
- width of each stripe is smaller than a width of each single customer roll, and
- positional frequency is selected so that one oscillation cycle covers 0.1-10 peripherical lengths in a machine roll and 1-100 peripherical lengths in a customer roll defined as peripheries of full rolls.

Thanks to the novel method, the telescoping problem which may cause challenges to the manufacturing method and decrease production efficiency of the manufacturing process, may be avoided.

Number of the positionally alternating adhesive stripes in a customer roll is one or more than one, preferably equal to or more than 2, more preferably equal to or more than 4, and most preferably equal to or more than 6. The number of adhesive stripes in the customer roll is used to adjust the overall tackiness of the label and reduce adhesive contamination in the linerless printers. Further a higher number of adhesive stripes provides removability of the label and capability to tack onto uneven surfaces. Further, preferably, number of the positionally alternating adhesive stripes in a customer roll is equal to or less than 15, more preferably equal to or less than 12, and most preferably equal to or less than 10. A larger number of the stripes does not typically provide any further benefits but makes the manufacturing of the label web more complicated. Thus, with a suitable number of adhesive stripes it is possible also to avoid the telescoping problem while obtaining good properties for the customer rolls.

In order to avoid the telescoping problem of the machine rolls, positional frequency of the adhesive stripe can be selected so that one oscillation cycle covers 0.1-10 peripherical lengths in a machine roll, defined as peripheries of a full roll. Further, in order to avoid the telescoping problem and improve properties of customer rolls, positional frequency of the adhesive stripe can be selected so that one oscillation cycle covers 1-100 peripherical lengths in a customer roll defined as peripheries of full rolls.

Thus, positional frequency of the adhesive stripe can be selected so that one oscillation cycle covers equal to or more than 0.1 peripherical lengths in a machine roll, more preferably equal to or more than 0.4 peripherical lengths in a machine roll, and most preferably equal to or more than 0.8 peripherical lengths in a machine roll, defined as peripheries of the full machine roll. Further, preferably, positional frequency of the adhesive stripe is selected so that one oscillation cycle covers equal to or less than 10 peripherical lengths in a machine roll, more preferably equal to or less than 6 peripherical lengths in a machine roll, and most preferably equal to or less than 3 peripherical lengths in a machine roll, defined as peripheries of the full machine roll. Thus, the telescoping problem of the machine rolls may be avoided. Further, easiness of the manufacturing process having such positional frequency may be improved.

Further, positional frequency of the adhesive stripe can be selected so that one oscillation cycle covers equal to or more than 1 peripherical lengths in a customer roll, more preferably equal to or more than 10 peripherical lengths in a customer roll, and most preferably equal to or more than 30 peripherical lengths in a customer roll, defined as peripheries of the full customer roll. Further, positional frequency of the adhesive stripe can be selected so that one oscillation cycle covers equal to or less than 100 peripherical lengths in a customer roll, more preferably equal to or less than 80 peripherical lengths in a customer roll, and most preferably equal to or less than 60 peripherical lengths in a customer roll, defined as peripheries of the full customer roll. Thus, the telescoping problem of the customer rolls may be avoided. Further, some properties of the customer roll may be improved.

A driving speed of a web, while providing the one or more than one positionally alternating adhesive stripe, can be in a range between 100 m/min and 600 m/min. Therefore, a speed of the web may correspond approximately to 1-10 m/s. Said speed may improve easiness of the coating process of the positionally alternating adhesive stripes.

The step providing one or more than one positionally alternating adhesive stripe may comprise the following steps:

applying an adhesive on to the face and thermally drying the adhesive into a pressure sensitive adhesive on the face, or applying the adhesive on to a carrier material, thermally drying the adhesive into a pressure sensitive adhesive on the carrier material, and transferring the pressure sensitive adhesive coating on to the face.

The step providing one or more than one positionally alternating adhesive stripe may comprise the following steps:

applying at least one continuous layer of adhesive, removing, in an oscillating manner, at least 50% of the applied adhesive coating prior to drying by using an oscillating actuator in order to provide the one or more than one positionally alternating adhesive stripe and adhesion-free areas.

The oscillating actuator may comprise a blade, which may be used to remove at least some of the applied adhesive.

Thus, the adhesion-free areas may comprise a residual amount of the adhesive coating in a range of 0.5-5.0 g/m$^2$. In addition, or alternatively, a dry weight content of the adhesive coating after being removed from the substrate may be 0.1-5% lower than a dry weight content of the adhesive coating applied onto the substrate. In addition, or alternatively, a dwell time between applying the adhesive coating and removing the adhesive coating may be from 0.05 to 3 seconds.

In an embodiment, the step providing the one or more than one positionally alternating adhesive stripe comprises:

applying the adhesive coating locally by using an oscillating actuator in order to provide the one or more than one positionally alternating adhesive stripe.

In this embodiment, the oscillating actuator preferably comprises a nozzle for applying the adhesive.

The positionally alternating adhesive stripe has a predetermined width of the stripe, a predetermined positional amplitude, and a predetermined positional frequency. The predetermined positional frequency defines a wavelength of the stripe.

The width of each stripe is smaller than a width of each single customer roll. The width of each stripe may be smaller than 0.5 times a width of each single customer roll. The width of the stripe may be equal to or less than a width of an adjacent adhesion free area. Still further, width of each stripe is preferably smaller than width of the smallest single customer roll, obtained from the machine roll. Thus, it is possible to avoid a telescoping problem of linerless label rolls while providing good adhesion level for the pressure sensitive label.

A typical width of a linerless customer roll may be around 2 inches, for example 58 millimeters. In such case the adhesive stripes may have 5 mm width separated by 5 mm areas without adhesive. The positional amplitude of the stripes, as explained further below, may be, for example from 15 mm to 25 mm.

Further, the one or more than one positionally alternating adhesive stripe has the positional amplitude. The positional amplitude is determined in the cross direction CD of the linerless label web. The positional amplitude refers to a height of one wave (from a bottom of the stripe to a top of the stripe), determined in the cross direction CD of the linerless label web. When measuring the positional amplitude, each location of the positionally alternating adhesive stripe is determined from a center of the adhesive stripe.

The positional amplitude can be selected to be in the range between 0.1 and 1 times the width of each customer roll. The positional amplitude is preferably equal to or more than 0.1 times the width of each customer roll, more preferably equal to or more than 0.2 times the width of each customer roll, and most preferably equal to or more than 0.3 times the width of each customer roll. Further, the positional amplitude is preferably equal to or less than 1 times the width of each customer roll, more preferably equal to or less than 0.8 times the width of each customer roll, and most preferably equal to or less than 0.7 times the width of each customer roll, such as in a range of 0.3 to 0.7 times the width of the customer roll. Thus, each customer roll has the adhesive coating through the whole length of the web, i.e., whole length of one customer roll has the adhesive coating on its surface. Further, said positional amplitude can help to prevent the telescoping problem by preventing the edges of the adhesive stripes becoming "build up" in the same position on successive layers in the customer roll. The additional technical benefit being that in the linerless printer, the adhesive residue buildup, which may be more pronounced at the edges of the adhesive stripes, is distributed over a wider cross-directional area. Because the non-adhesive stripes also have high affinity regarding the adhesive (for good adhesive anchorage), these areas also tend to clean up the printer internals from any loose adhesive residue.

Advantageously, the pressure sensitive adhesive comprises water-based acrylic adhesive.

Total coverage of the adhesive coating can be equal to or less than 50% calculated from the total area of the second side of the face. In addition, the total coverage of the pressure sensitive adhesive coating may be equal to or more than 10%, more preferably equal to or more than 30%, and most preferably equal to or more than 40%, calculated from the total area of the second side of the face. Thus, it is possible to prevent the telescoping problem of the linerless label roll by using said total area of adhesive together with the positionally alternating adhesive stripes.

Thanks to the novel solution, a linerless label web comprising pressure sensitive adhesive coating comprising one or more in a predetermined manner positionally alternating adhesive stripes and adhesion-free areas on the second side of the face can be obtained. This allows the linerless label web to be self-wound into a larger machine rolls without suffering from telescoping effect which would significantly complicate or even prevent later unwounding and lengthwise slitting into narrower customer rolls. Preventing machine roll telescoping may be taken as the primary aim of this invention. However, the invention can further provide significant benefits also for the smaller customer rolls ranging from avoiding telescoping into causing less adhesive contamination in the linerless printers.

"Predetermined" is to be understood in the sense that the positional alternating adhesive stripes are designed to provide benefits in view of the larger machine rolls as well as the smaller customer rolls. Thus, the positional alternating is specifically designed to provide benefits both in the machine roll and in the customer rolls.

"Positionally alternating" is further broken here into two main components: positional frequency of the adhesive stripes changing their position in the lengthwise direction of the web and positional amplitude of the stripes in the cross-direction of the web. Together these parameters define how quickly and how much the adhesive stripes change their position along the length of the web.

It should be noted that typically, the coating thickness of the adhesive coating as well as the width of the adhesive stripes (as well as the adjacent adhesive or adhesion free areas) remain substantially constant over the length of the web despite of the positional alternation. This allows for technically easier implementation of the coating process as well as simplifies curing/drying of the adhesive layer. In the customer rolls, for example, the decreased and positionally alternating adhesive coating may improve the functioning of the motorized or manual guillotine in linerless printers. Still further, linerless labels comprising adhesive stripes might be easier to cut through mechanically in such devices with less adhesive residue left on the cutting blade or edge. Furthermore, it might be easier to achieve good anchorage with water-based acrylic PSA onto the substrate, in some cases even without any additional primer being used.

Thus, the novel solution may have one or more of the following advantages:

- Smooth outer surface of the roll both in the machine or customer roll,
- No telescoping in the machine roll,
- No telescoping in the customer roll,
- No adhesive bleeding/oozing, even if there are some adhesives at the edges of the customer roll,
- Adhesive residue reduction in any parts contacting the web during manufacturing (coating, slitting) or end use (printer),
- Allow to slit any coil widths without specific adjustment, and
- Acrylic water-based adhesive may be environmentally friendly adhesive, which may be used e.g. with food materials.

The waveforms produced by the predetermined selection of the positional frequency and the positional amplitude of the stripes may range from smoothly varying sinusoidal waveforms into more sharply changing, almost stepwise changing waveforms. All of these can however be characterized with having a certain positional main frequency and main amplitude behavior.

The selection of the exact waveforms is to certain extent tied into technical practicalities in providing the adhesive coating in a positionally alternating manner. Coating a flowing liquid adhesive with small tolerances in the coating thickness favors selection of smoother waveforms which are also technically easier to implement from required mechanical actuator point of view.

BRIEF DESCRIPTION OF THE DRAWINGS

In the following, the invention will be described in more detail with reference to the appended drawings, in which.

Figure 1:
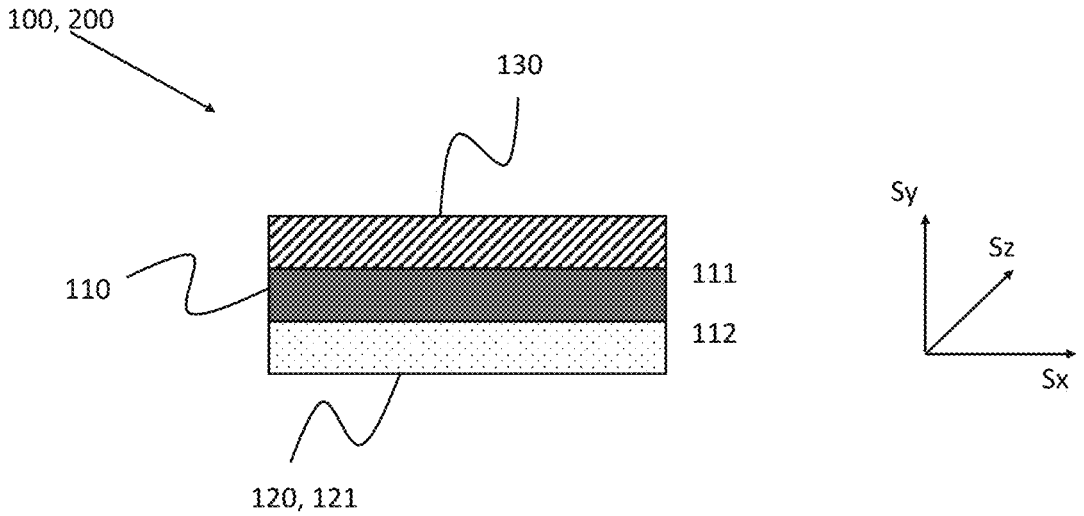
FIG. 1 illustrates, by way of an example, an $S_x$,$S_y$-cross-section of a linerless label (web)

The figures are schematic and are intended to illustrate the general principles of the disclosed solution. Therefore, the illustrations in the Figures are not necessarily in scale or suggestive of precise layout of system components.

DETAILED DESCRIPTION

The solution is described in the following in more detail with reference to some embodiments, which shall not be regarded as limiting.

In this specification, references are made to Figures, in which the following reference numerals and denotations are used:

Sx, Sy, Sz 3D coordinates,
MD machine direction, first direction,
CD cross direction, second direction,
A-M oscillating movement of the actuator,
A1 positional amplitude, i.e., a height of one wave from a bottom of the wave to a top of the wave,
P1 one period
WL wavelength, i.e., positional wavelength,
WMR width of a machine roll,
WCR width of a customer roll,
DMR diameter of a machine roll,
DCR diameter of a customer roll,
WA width of adhesive in an adhesive stripe,
100 linerless label web,
110 face, face stock,
111 first side, i.e., top side,
112 second side, i.e. bottom side,
120 pressure sensitive adhesive coating (PSA) comprising adhesive stripes,
121 adhesive coating,
130 release coating, release coating layer,
150 adhesion-free area,
150*a* adhesion-free areas/stripes on the longitudinal edges,
200 linerless label, label (product),
300 linerless label customer roll,
400 oscillating actuator,
401 arranging a face stock,
402 applying adhesive,
402*a* applying adhesive on a face,
402*b* applying adhesive on a carrier material,
403 arranging adhesion-free areas,
404 ensuring pre-determined level of moisture,
405 drying the adhesive,
406 transferring the adhesive onto a face,
407 winding the material into linerless roll,
560 drying unit,
561 drying device,
570 linerless label machine roll,
580 coating unit for applying adhesive,
580*a* transfer roll of a coating unit,
580*b* nozzle of a coating unit,
611, 611*a*, 611*b* carrier material,
611*a* belt,
611*b* web material,
612 face unwinder,
650 cooling cylinder,
660 roll nip,
690 adhesive removal unit,
710 carrier unwinder,
770 linerless label web winder,
780 carrier rewinder, and
870 blocking shims.

In this specification term "comprising" may be used as an open term, but it also comprises the closed term "consisting of".

Unit of temperature expressed as degrees C. corresponds to ° C.

Percentage values relating to an amount of a material are percentages by weight (wt. %) unless otherwise indicated. All percentage values refer to dry weight unless otherwise indicated.

Term "web" refers to a continuous sheet of material. The web is generally processed by moving over rollers. Between processing stages, webs may be stored and/or transported as rolls.

In this application, the term "linerless label web" refers to a continuous web comprising a face 110 and pressure sensitive adhesive 120, wherefrom the linerless labels 200, i.e. the individual labels, may be separated.

In this application, the terms "label", "linerless label" and "adhesive label" refer to an individual label product 200 separated from the linerless label web 100 to be applied onto an article, unless otherwise indicated. The label 200 can be adhered onto an article by using an adhesive. Thus, in this application, the terms "label", "linerless label" and "adhesive label" refer to a product comprising the face 110 and the pressure sensitive adhesive coating 120, unless otherwise indicated.

In this application, the term "linerless label (web)" refers to the label 200 and/or to the linerless label web 100.

The term "PSA" refers to pressure sensitive adhesive(s).

Term "machine direction" refers to manufacturing direction MD of a web. Machine direction MD may also refer to a circumferential direction of a roll. Further, longitudinal direction and lengthwise direction of a web both refer to the machine direction. In this application, the term "first direction" refers to the machine direction.

Terms "cross direction" and "cross machine direction" and "transversal direction" refer to a direction that is transversal to the machine direction. In this application, the term "second direction" refers to the cross-direction CD.

The term "face" refers to a substrate of the label, also called as a face stock or a face material. In case of a plastic face material, it may also be called a face film.

In this application, the term "adhesive layer" refers to a layer comprising positionally alternating adhesive stripes. Thus, the adhesive layer comprises areas with adhesive and areas without adhesive. The positionally alternating adhesive stripes can be, at least in the machine roll, continuous stripes. The positionally alternating adhesive stripes have a predetermined width, a predetermined positional frequency, and a predetermined positional amplitude. The adhesive layer may consist of the positionally alternating adhesive stripes.

The terms "positionally alternating adhesive stripe" refers to a shaped adhesive stripe having the predetermined width, positional frequency, and positional amplitude.

The linerless label web has the positionally alternating continuous adhesive stripes having

- predetermined number of the stripes (A) in cross-direction of the web 100,
- predetermined width of the stripes (B) in the cross-direction of the web 100,
- predetermined positional frequency (C) of the stripes in the lengthwise direction of the web 100, and
- predetermined positional amplitude (D) of the stripes in the cross-direction of the web 100.

The predetermined number of the stripes in each single customer roll 300 is preferably selected to be one or more. The predetermined width of each stripe is preferably selected to be smaller than a width of each single customer roll 300. The predetermined positional frequency is preferably selected so that one oscillation cycle covers 0.1-10 peripherical lengths in a machine roll and 1-100 peripherical lengths in a customer roll 300, defined as peripheries of full rolls. The predetermined positional amplitude is preferably selected to be in the range of 0.1-1 times the width of a customer roll 300. By using all these features, it may be possible to avoid telescoping of machine rolls and customer rolls. Further, easiness of the manufacturing process may be improved while avoiding the telescoping problem. Further, at least some properties of the customer roll 300 may be improved while avoiding the telescoping problem.

The positionally alternating adhesive stripe is preferably in a form of a sinusoidal wave in order to increase easiness of the manufacturing process of the linerless label web. Thus, each positionally alternating adhesive stripe may have a shape of a sinusoidal wave. However, in an embodiment, the positionally alternating adhesive stripe may have other form, such as a square, a triangular, or some other form. The positionally alternating adhesive stripes may have a wave form wherein the single wave is repeating several times in the length direction (machine direction) of the linerless label web. This may improve the easiness of the production and, hence, the production efficiency may be improved.

Thus, "positionally alternating" refers to adhesive stripes changing their position in the lengthwise direction of the web (i.e., the machine direction). The adhesive stripes are preferably continuous stripes having even, or substantially even, adhesive thickness and stripe width over the manufacturing length of the web.

The positional alternation of the adhesive stripes of the web is predetermined. "Predetermined" in this context is to be understood in the sense that the positional alternating adhesive stripes are designed to provide benefits in view both of the larger machine rolls as well as the smaller customer rolls.

"Positionally alternating" is further defined using the following main components: "positional frequency" of the adhesive stripes changing their position in the machine or lengthwise direction of the web and "positional amplitude" of the stripes in the cross direction of the web. Together these parameters define how quickly and how much the adhesive stripes change their position along the length of the web.

Being predetermined in their nature, the above positional alternating parameters are derived from physical dimensions from the machine and customer rolls as well as parameters of the web manufacturing process. For the latter, one of the important parameters is the speed of the web during the adhesive coating process where also the positionally alternating stripes become formed. These principles are explained below.

Typical machine roll diameter DMR in linerless web production is 500-1500 mm (0.5-1.5 m) although most of the rolls have a maximum diameter around 1000 mm. This means that on top of the full machine roll one layer around the roll periphery is approximately 1-5 meters long. Typical linerless customer roll 300 diameter DCR is 50-150 mm (0.05-0.15 m) making it about 10 times smaller and reflecting into the top of roll layer peripheral lengths being in the order of 0.1-0.5 meters. As understood, when looking into mid roll or near empty roll peripherical lengths, those approach the values determined by the winding core sizes. These core diameters range for customer rolls typically from 50-200 mm and for customer rolls from 5-20 mm.

During adhesive coating, the web may be moving 100-600 meters per minute turning into web speeds corresponding approximately 1-10 m/s.

In this invention it has been noticed that machine roll telescoping can be efficiently avoided if adhesive stripes are coated using a certain predetermined positional frequency and amplitude making the adhesive stripes to have a certain positional alternation along the length of the web and this alternation derived from the dimensional properties of the machine as well as the customer rolls.

According to the invention the positional frequency is selected so that one oscillation cycle covers 0.1-10 peripherical lengths in a machine roll and, correspondingly 1-100 peripherical lengths in a customer roll 300 defined as peripherical lengths of full rolls.

The above feature arises from the fact that with adhesive coating web speeds in the range of 1-10 m/s, one oscillation cycle becomes spread onto a suitable number of successive layers in the machine roll this number of layers being low enough to prevent telescoping of the machine roll. In case the machine roll periphery is approximately 1-5 meters long then 0.1-10 peripherical lengths of the roll correspond to 0.1-50 meter oscillation lengths. Further, this frequency is also low enough to become reflected on the customer rolls having approximately 10 times smaller diameters and peripherical lengths.

The oscillation cycle according to the invention may be 0.1-10 peripherical lengths, preferably 0.5-5 peripherical lengths or even more preferably around 1 peripherical length. Thus, it can be possible to prevent telescoping of the machine roll, as discussed above. One working embodiment includes one oscillation cycle to cover a length of 3-4 meters on a machine roll.

The technical reason for indicating the oscillation cycle as peripherical lengths of the rolls instead of simply indicating it as length in meters arises from the fact that the size of both the machine rolls and the size of the customer rolls vary and both of them needs to be taken into account when optimizing the positional frequency. The positional frequency further depends on the speed of the web during adhesive coating process.

Further, according to the invention the positional amplitude is selected to be in the range of 0.1-1 times the width WCR of each customer roll 300. This can ensure that the whole length of one customer roll 300 has the adhesive coating on its surface. Further, at least one continuous adhesives stripe may fit within one customer roll 300 width. According to one embodiment the positional amplitude is larger than the width of individual adhesive stripes. This helps further to avoid, in a machine roll or customer roll 300, the edges of the adhesive stripes in successive layers overlaying each other and building up areas where there exists a significant gradient in the thickness of the layers over a short cross-directional distance. Such gradients tend to push the successive layers in cross-direction due to the internal pressure building into the roll causing telescoping.

Number of stripes within a single customer roll 300 may preferably be from 2-6, for example in a range between 3 and 4. This may help to prevent the telescoping while improving some properties of the customer roll 300. Making the number of stripes in a single customer roll 300 over 10 does not provide any further significant benefits but only complicates the manufacturing.

In the following, the different components of the linerless label web are described in more detail.

Face

The face 110 may have a monolayer structure, or it may have a multilayer structure comprising equal to or more than two layers. The face 110 is the layer that is adhered to a surface of an article through an adhesive coating. The face 110 comprises a first side 111 and a second side 112. The second side 112 is an adhesive side, and the first side 111 can be a print side. The face 110 may comprise e.g. a print to provide information and/or visual effect.

Further, the linerless label (web) 100, 200 may contain additional layers, for example top coatings or overlaminates to protect the top surface and/or print of the label against rubbing or other external stress. Further, a primer may enable enhancing compatibility of adjacent layers or parts of the label, for example adhesion between the layers. The face 110 may contain one or more barrier layers to prevent chemical substances from migrating through a surface of the first side 111 of the face or a surface of the second side 112 of the face, or other interfaces of the linerless label (web) 100, 200.

A linerless label (web) 100, 200 comprising a face 110, a print layer and a pressure sensitive adhesive coating 120 may be referred to as a printed label. In an embodiment, the first side 111 of the linerless label (web) can be printable by using heat.

The face 110 may comprise a paper comprising natural fibres as its main raw material. Natural fibres refer to any plant material that contains cellulose. The natural fibre may be wood based. The wood based natural fibre may be from softwood trees, such as spruce, pine, fir, larch, douglas-fir, or hemlock, and/or from hardwood trees, such as birch, aspen, poplar, alder, eucalyptus, or acacia, or from a mixture of softwoods and hardwoods. The face 110 may comprise cellulose fibers from both hardwood and softwood. A mixture of hardwood and softwood may be used to improve the internal bond strength of the face 110.

A paper suitable for the face 110 is typically so-called wood-free paper. Wood-free refers to chemical pulp, such as Kraft pulp. In accordance with an embodiment, a pulp used for making the face does not contain any kind of mechanical pulp due to high quality requirements of the face. Thus, the face 110 may be a wood-free paper comprising fibers e.g. from softwoods and/or hardwoods.

The face 110 may comprise, for example, at least one filler selected from a group comprising clay, calcined clay, kaolin, natural ground calcium carbonate, precipitated calcium carbonate, talc, calcium sulphate, and titanium dioxide. The total amount of the fillers in the face 110 is preferably less than 10 weight-%, more preferably less than 5 weight-%, and most preferably less than 3 weight-%, for example between 0.5 and 5 wt.-%, or between 0 wt.-% and 3 wt.-%, based on the total weight of the face 110. The fillers may decrease costs of the manufactured product. However, the mineral fillers may also decrease strength properties of the face 110. Further, if the face comprises too much mineral fillers, some properties of the face 110 may be compromised. Thus, in an example, the face 110 does not comprise said mineral fillers.

The face 110 may comprise a paper which is coated with one or more coatings. For coated papers, a coat weight in the range of 1 to 12 g/m$^2$ per side (on one or both sides) may be used. The coating layer(s) may comprise at least one pigment selected from a group comprising clay, calcined clay, kaolin, natural ground calcium carbonate, precipitated calcium carbonate, talc, calcium sulphate, and titanium dioxide. Further, said coating layer(s) may comprise binders, such as starch and/or polyvinyl alcohol. The face may further comprise additive(s).

A face 110 comprising a paper may be calendered with a calender or a supercalender to obtain a high-density surface.

In addition to the paper, or alternatively, the face 110 may comprise a filmic material such as polyethylene (PE), polypropylene (PP), or biaxially oriented polypropylene (BOPP). Also, other suitable materials, such as different types of polyesters such as polyethylene terephthalate (PET) or polyethylene(s) are possible.

The grammage of the face 110 is preferably at least 50 g/m$^2$, more preferably at least 60 g/m$^2$. Further, the grammage of the face is preferably less than 85 g/m$^2$, more preferably equal to or less than 80 g/m$^2$. Grammage may be, for example, in a range between 50 g/m$^2$ and 82 g/m$^2$ or in a range between 70 and 80 g/m$^2$. The grammage can be measured according to standard ISO536.

In an embodiment, the linerless label is thermally printable and the face 110 may have a static sensitivity below 90 degrees C., preferably in a range between 75° C. and 90° C. Thus, if the linerless label is thermally printable, the static sensitivity may be high enough so that the product is not darkening before printing, for example during transportation. However, said static sensitivity level is sensitive enough to be thermally printable. In another embodiment, the linerless label is not thermally printable and it may not have said static sensitivity.

The face 110 may have an optical density of below 25 mJ/mm$^2$, preferably below 20 mJ/mm$^2$, and more preferably below 15 mJ/mm$^2$, such as between 10 mJ/mm$^2$ and 15 mJ/mm$^2$. Too high optical density may cause challenges to the product. Further, low optical density may speed up the linerless label printer. Moreover, thanks to low enough optical density, the linerless label may not cause too many demands for printers.

The face 110 may have a caliper in a range between 60 μm and 85 μm, measured according to ISO534. If the face it is too thin, the linerless label (web) 100, 200 may be difficult to handle. For example, if the face is very thin, a stiffness of the linerless label may go too low causing the linerless label to be too sloppy. Thus, the linerless label (web) may be difficult to manufacture and/or the linerless label (web) may cause problems when used with a printer.

The top side of the linerless label may have a smoothness at least in a range between 350 sec and 550 sec (Beck), measured according to standard ISO5627. For example, by using a face comprising a paper, if the paper is too rough, the life of a print head (if the label is to be printed) may decrease too much.

The face may comprise a release layer such as a silicon layer on top of the face. The release layer will smooth the linerless label (web) and, hence, the product may be better for printers. Thus, the face 110 may be pre-coated and the pre-coat may have effect of providing smoothness to the substrate, i.e. the top surface of the face 110. Smoothness of the face 110 comprising paper has positive effect on printing, for example by providing better resolution. The pre-coat may have positive effect on printing quality. In an embodiment, the first side of the linerless label may have a smoothness of equal to or more than 1000 sec (Beck), measured according to standard ISO5627.

The linerless label (web) may have a brightness higher than 85% (R457) when measured according to standard ISO2469. Therefore, the linerless label may look nice. Further, high brightness may create a contrast between the symbols/letters. Thus, if the letters comprise some machine-readable letters, the letters may be easily read thanks to said brightness.

The linerless label may have an opacity higher than 80%, such as in a range between 80 and 90, when measured according to standard ISO2471. Thanks to said opacity, the surface of the linerless label may not be too transparent for a machine, or a human eye, to read.

The face 110 and/or the linerless label (web) may have a tensile strength in the machine direction (i.e., the first direction) higher than 40 N/15 mm, preferably higher than 45 N/15 mm, when measured according to standard ISO1924/2. Thus, dimensional stability of the linerless label (web) may be improved, which may have a positive effect on the manufacturing process and a printing process of the linerless label web.

The face 110 and/or the linerless label (web) may have a tensile strength in the cross direction (i.e., the second direction) higher than 10 N/15 mm, when measured according to standard ISO1924/2. Thanks to said strength, a dimensional stability of the linerless label may be improved, which may affect manufacturing process and printing process.

The face 110 may have a paper substrate manufactured from FSC™-certified (mix credit) pulp. Thus, the face may comprise or consist of environmentally friendly material. Thus, the novel linerless label (web) may be better for the environment than some other kind of face materials.

Adhesive

The label 200 and the linerless label web 100 disclosed herein comprise the adhesive coating 120, 121 comprising at least one positionally alternating adhesive stripe. The pressure sensitive adhesive coating may also be called a self-adhesive coating. The adhesive coating 120, 121 comprising at least one positionally alternating adhesive stripe comprises both, areas with adhesive, and areas without adhesive. The adhesive areas comprise positionally alternating adhesive stripes. Advantageously, the adhesive coating comprises or consists of positionally alternating adhesive stripes having adhesive free area between adjacent adhesive stripes. The adhesive coating may comprise one or more than one positionally alternating adhesive stripe in a shape of sinusoidal wave, thus, the adhesive coating may comprise or consist of at least one adhesive stripe having a shape of sinusoidal wave.

Pressure sensitive adhesives may be permanent adhesive, or it may be removable or repositionable, or even ultra-removable. Further, pressure sensitive adhesives may have a working temperature from ambient to freezer temperatures.

The pressure sensitive adhesive 120 may have a maximum tack value of equal to or more than 3 N, more preferably equal to or more than 4 N measured on glass according to FINAT test method FTM9. Said values may be suitable performance values for the pressure sensitive adhesive coating 120 of the linerless label (web) 100, 200.

The pressure sensitive adhesive may be used for permanent linerless label (web) or removable linerless label (web). For removable linerless label (web), the maximum tack value is preferably between 3 N and 6 N measured on glass according to FINAT test method FTM9. For permanent linerless label (web), the maximum tack value is preferably equal to or more than 8 N, more preferably equal to or more than 10 N, and most preferably equal to or more than 17 N, measured on glass according to FINAT test method FTM9.

In an embodiment, the pressure sensitive adhesive 120 has a maximum tack value of equal to or less than 12 N, more preferably equal to or less than 6 N and most preferably between 3 N and 6 N as measured on glass according to FINAT test method FTM9. Said values may be particularly suitable performance values for the pressure sensitive adhesive coating 120 of the linerless label (web) 100, 200 for quick service restaurants.

In another embodiment, the pressure sensitive adhesive 120 has a maximum tack value of equal to or more than 8 N, more preferably equal to or more than 10 N as measured on glass according to FINAT test method FTM9. Said values may be particularly suitable performance values for the pressure sensitive adhesive coating 120 of the linerless label (web) 100, 200 for industrial food or retail labeling.

In another embodiment, the pressure sensitive adhesive 120 may have a maximum tack value of equal to or more than 15 N, more preferably equal to or more than 17 N as measured on glass according to FINAT test method FTM9. Said values may be particularly suitable performance values for the pressure sensitive adhesive coating 120 of the linerless label (web) 100, 200 for logistic and warehouse.

Properties and characteristics of the PSA used herein may vary depending on the end use of the label in question. Some properties are illustrated by Table 1 showing some preferred values and factors for the adhesives for different end uses.

TABLE 1

| | | Retail labelling | Logistic, warehouse | Industrial food | Quick service restaurant |
|---|---|---|---|---|---|
| Labelling environment | (° C.) | 18 . . . 25 | 10 . . . 25 | −2 . . . 8 | 18 . . . 30 |
| Labelling environment (substrate) | (° C.) | 8 . . . 25 | 10 . . . 25 | −20 . . . 8 | 8 . . . 60 |
| Environment (substrate) | | Dry | Dry | condens. Exists | condens. exists |
| Service temperature | (° C.) | 4 . . . 25 | 0 . . . 25 | −20 . . . 25 | 18 . . . 30 |
| Adhesive characteristics | | permanent | Permanent | permanent | removable |
| Adhesion (tack) | N/ 25 mm FTM9 | ≥8 | ≥17 | ≥10 | 3 . . . 6 |
| Coat weight (dry) | (g/m$^2$) | 15 . . . 20 | 18 . . . 25 | 15 . . . 20 | 15 . . . 20 |

Within context of this specification, the pressure sensitive adhesive is preferably water-based PSA. Water-based adhesives can provide better sustainability with less fossil based raw materials and less volatiles involved both during the manufacturing and during end use.

Further, it might be easier to achieve a good anchorage level with water-based PSA onto the face 110 disclosed herein even without any additional primer being used. Thus, in an embodiment, the water-based pressure sensitive adhesive 120 is directly in contact with the face 110, without any further coating layers between the PSA and the face. Thus, in an embodiment, the adhesive exhibits sufficient anchorage to the face 110 and resistance to face stock penetration, such that priming is not required. Flat adhesion profile over extended dwell-time and/or sufficient cohesion in order to resist winging on curved surfaces may be preferred. However, in an embodiment, the linerless label (web) comprises said priming.

Still further, water-based adhesives may be designed to have approval for direct or indirect food contact (food-safety), which is a requirement in certain food related label end use areas.

The pressure sensitive adhesive can be suitable for high coating speeds. Preferably, the adhesive gives reticulation free coatings at coat weights of 10-30 g/m$^2$ (dry coat weight).

Preferably, the water-based PSA is acrylic-based, i.e., the adhesive is most preferably a water-based acrylic adhesive. The water-based acrylic PSA may have many advantages over other kinds of PSAs. Water-based acrylic PSA may be environmentally friendly. Further, tackiness of the product may improve thanks to the water-based acrylic adhesive. Furthermore, hot melt adhesives may cumulate more easily e.g. into cutting machines than water-based acrylic adhesives. Still further, acrylic adhesives may have a longer open time, hence, linerless label (web) comprising water-based acrylic PSA may be removed after some seconds or minutes, if needed. On the contrary, hot melt adhesives cannot typically be removed from a surface, even if attached onto a wrong surface. Thus, removability of the water-based acrylic adhesive may be better than removability of the hot melt adhesives. Moreover, peel values of the acrylic based adhesive typically differ from peel values of the hotmelt based adhesives. Still further, the water-based acrylic adhesive may be the most preferred adhesive for the novel solution.

Thus, the adhesive coating may comprise water-based acrylic adhesive coating. The water-based acrylic adhesive coating may comprise, for example:

butyl acrylate (BA), or 2-hydroxyethyl acrylate (2EHA), or butyl acrylate (BA) and 2-hydroxyethyl acrylate (2EHA).

The total content of the butyl acrylate and/or 2-hydroxyethyl acrylate may be, in an example, at least 20%, preferably at least 45%, or at least 58%, calculated from the dry weight of the water-based acrylic adhesive. The water-based acrylic adhesive comprising butyl acrylate may be a permanent adhesive, while the adhesive comprising 2-hydroxyethyl acrylate without the butyl acrylate may be a removable adhesive.

The water-based acrylic adhesive may be a tackified acrylic adhesive. The tackified acrylic adhesive may be used to provide aggressive adhesion to a surface.

The adhesive coating 120, 121 may be plasticizer-free. The plasticizer-free adhesive may be used e.g. on thermal papers (including economy grades) without issues of premature image development or image fade. This may have several advantages as plasticizers may migrate into the product and cause some problems. For example, food safety might be compromised.

The adhesive coating may comprise at least one surface-active agent. The surface-active agents, in general, are compounds that lower the surface tension (or interfacial tension) between two liquids, between a gas and a liquid, or between a liquid and a solid.

In an embodiment, the adhesive coating may comprise at least one surface-active agent. The adhesive coating may comprise, for example, two different surface-active agents, such as an emulsifier and a wetting agent.

In an embodiment, the adhesive coating comprises the wetting agent. The wetting agent may be added into the adhesive coating to improve the coating process of the adhesive coating. The wetting agent may increase spreading and penetrating properties by lowering a surface tension. The person skilled in the art knows the wetting agents.

In an embodiment, the adhesive coating comprises silicone. The silicone in the adhesive coating 120, 121 may improve the easiness of cutting of the label material, particularly with an on-demand linerless label printer. Further, the silicone in the adhesive coating 120, 121 may improve the self-woundability of the linerless label web 100. Thus, thanks to the silicone in the adhesive coating 120, 121 the linerless label web 100 may be self-wound around itself easily without any tendency of blocking the adjacent layers of the linerless label web 100 to each other. Therefore, in an embodiment, the adhesive comprises

- a silicone component, for example, a silicone oil (polydimethylsiloxane), and
- an emulsifier, and
- optionally, a wetting agent.

However, the silicone is only an optional feature, hence, the adhesive coating does not need to comprise said silicone.

In an embodiment wherein the adhesive coating comprises said silicone, the pressure sensitive adhesive coating may comprise

- an adhesive, wherein the amount of the adhesive may be in a range between 90 wt. % and 99 wt. % calculated from the total dry weight of the pressure sensitive adhesive coating, and
- a silicone additive, the amount of the silicone additive being in a range between 1 wt. % and 6 wt. %, preferably in a range between 2 wt. % and 4 wt. % calculated from the total dry weight of the pressure sensitive adhesive coating.

Positionally Alternating Adhesive Stripes

The face 110 is attached to another surface with the adhesive coating 120 when the label 200 is used. Thus, when label 200 is used, the adhesive coating 120 bonds the label 200 to the surface of an item. In this specification, the adhesive coating comprises one or more than one positionally alternating adhesive stripe, and adhesive free areas.

Figure 2A:
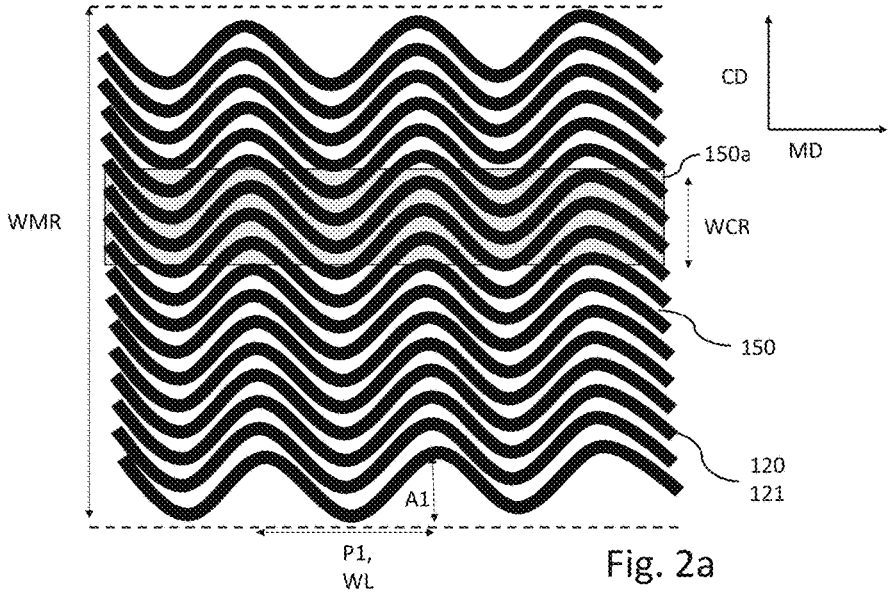
FIG. 2*a* illustrates, by way of example, positionally alternating adhesive stripes on a surface of the linerless label.
Figure 3A:
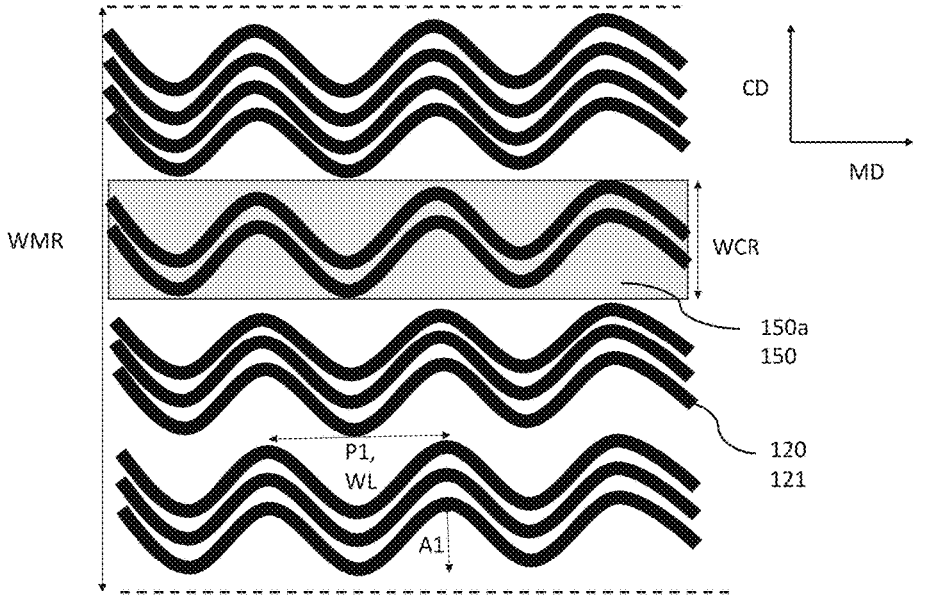
FIG. 3*a* illustrates, by way of example, positionally alternating adhesive stripes on a surface of the linerless label.

Referring to FIGS. 2*a* and 3*a*, the linerless label (web) 100, 200 can comprise positionally alternating adhesive stripes and adhesive free areas between said adhesive stripes. Adhesive free areas 150, 150*a* in the adhesive layer may be used, for example, to prevent a linerless label printer from an accumulation of the adhesive coating to a blade and rolls of the linerless label printer. Said accumulation of the adhesive might result shortened printer service cycle. Further, the adhesive free areas may be environmentally friendly. Still further, the adhesive free areas may lower production costs of the linerless label (web).

Figure 9A:
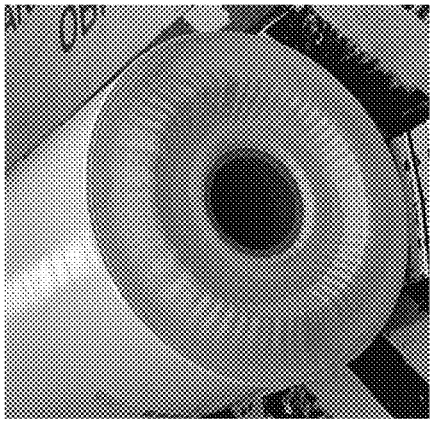
FIG. 9*a* shows a photo from experimental tests.

However, the adhesive stripes have caused several problems, such as the telescoping problem shown in FIG. 9*a*. Due to the telescoping, it has been difficult to use adhesive stripes on the linerless label web 100. However, thanks to the novel solution having positionally alternating adhesive stripes, the telescoping problem can be prevented while still obtaining the advantages of adhesive stripes.

The pressure sensitive adhesive layer 120 comprising the adhesive stripes may have a target coat weight in a range between 10 and 30 g/m$^2$ (dry coat weight). Further, the adhesive layer 120 comprising the adhesive stripes may have a target coat weight in a range between 15 g/m$^2$ and 25 g/m$^2$ (dry coat weight), most preferably in a range between 16 g/m$^2$ and 21 g/m$^2$. Preferably, to obtain an adhesive layer that is good enough to attach the linerless label to the surface of an item without being too expensive, the adhesive is a water-based PSA, which is acrylic-based.

It should be noted that a certain coating thickness (coat weight) is needed in order to obtain the water-based PSA as a uniform, defect free layer on the face 110. The adhesive stripes of the produced linerless label (web) 100, 200 may have a thickness of at least 10 μm, preferably at least 12 μm or at least 14 μm, and most preferably equal to or more than 16 μm. The coat weight of the PSA needs to be high enough to fill the pores of the surface. Thus, the thickness of the PSA may depend on the surface to be coated. Further, the amount of the PSA needs to be high enough to attach the label onto the surface of an object. Advantageously, the thickness of the adhesive stripes is equal to or less than 40 μm, preferably equal to or less than 30 μm, more preferably equal to or less than 25 μm, and most preferably equal to or less than 20 μm. The thickness of the adhesive stripes may be, for example, between 16 and 20 microns. Preferably, the thickness of the adhesive stripes remains constant both in machine and cross-direction of the stripes, however certain small deviations from the target thickness value may exist due to manufacturing tolerances. Therefore, it is possible to obtain an adhesive layer comprising adhesive stripes that is good enough to attach the linerless label to a surface of an item without being too expensive.

The pressure sensitive adhesive coating layer 120 may comprise one or more layers of adhesive. If the PSA coating 120 comprises more than one layer of adhesive, the adhesive coating may have improved smoothness. For example, if the first adhesive coating layer comprises any small holes, these may be filled with the second adhesive coating layer. This embodiment is particularly advantageous if the positionally alternating adhesive stripes are obtained by removing some adhesive in an oscillating manner from a continuous adhesive layer.

If the adhesive stripes are formed by applying the adhesive in an oscillating manner, the manufacturing process may be easier to control if the adhesive coating comprises only one layer of adhesive. Thus, in this embodiment, adhesive stripes comprise only one layer of adhesive.

As discussed, the usage of the adhesive stripes has caused new challenges for the manufacturing process of the linerless label (web). The adhesive stripes can cause machine rolls as well as customer rolls to have a telescoping problem. The telescoping may cause several problems in different process stages. The telescoping problem of the machine rolls can cause problems in a slitting machine. In the slitting machine, the machine roll is slitted into customer rolls. Due to the telescoping problem, the machine roll may not be even, which may cause several problems on a slitting machine. Typically, the faster you drive, the more problematic the telescoping problem on the slitting machine is. Due to the telescoping, the driving of the slitting machine may be more challenging and driving speed of the slitting machine may be reduced. Further, substantially wide area of the machine roll's edges might not be usable due to said telescoping problem. Further, the production efficiency of the slitting machine may be decreases if the driving speed of the slitting machine is decreased. Thus, the telescoping problem should be prevented instead of decreasing the driving speed of the slitting machine.

Still further, the adhesive stripes may cause said telescoping problem also for customer rolls, particularly for large customer rolls having a great length. Thus, conventionally, the usage of the adhesive stripes has caused many challenges for the manufacturing process of the linerless label rolls, which may have prevented the usage of the adhesive stripes.

The inventors of the present invention have surprisingly invented a novel solution wherein the telescoping problem caused by adhesive stripes may be prevented by using positionally alternating adhesive stripes. The novel solution may prevent at least some of the problems caused by the adhesive stripes.

The novel solution can comprise positionally alternating adhesive stripes comprising adhesive free areas between the adhesive stripes. Thus, the adhesive stripes 120, 121 may be in a form of positionally alternating adhesive stripes. This is illustrated in FIGS. 2*a-b* and 3*a-b*.

The positionally alternating adhesive stripes can have a positional amplitude A1 of the adhesive stripe in the cross-direction of the linerless label (web) 100, 200. The positionally alternating adhesive stripes can further have a positional frequency (forming a positional wavelength WL) in the machine direction of the linerless label (web) 100, 200. Therefore, the positionally alternating adhesive stripe can comprise the positional wavelength WL and the positional amplitude A1.

The positional wavelength WL is the distance that the one positional wave of the adhesive stripe travels on the web to produce one full cycle. One complete wave has the positional amplitude A1.

Figure 2B:
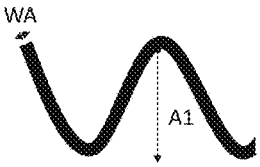
FIG. 2*b* illustrates the maximum distance (measured in the cross direction CD) within one wavelength (i.e., from a bottom of the adhesive stripe to the top of the adhesive stripe)
Figure 3B:
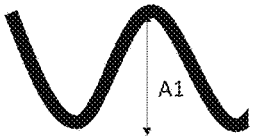
FIG. 3*b* illustrates the maximum distance (measured in the cross direction CD) within one wavelength (i.e., from a bottom of the adhesive stripe to the top of the adhesive stripe)

In this application, the maximum distance (measured in the cross direction CD) within one wavelength (i.e., from a bottom of the adhesive stripe to the top of the adhesive stripe, as illustrated in FIGS. 2*b* and 3*b*) is called as the amplitude A1. Thus, the amplitude A1 is the height of the wave, measured in the cross direction CD. The positional amplitude A1 of the wave of the adhesive stripe may be, for example, in a range between 15 mm and 25 mm.

Conventionally, adhesive stripes can increase internal pressure of the machine rolls. Too high internal pressure of a roll may cause telescoping problems. Thanks to the novel solution comprising positionally alternating adhesive stripes, the location of the adhesive can have a controlled variation so that an internal pressure of the machine rolls can be decreased. Thus, the telescoping problem may be prevented.

In order to avoid the telescoping problem, a location of the adhesive stripe may need to be moved in a predetermined manner, in the cross direction, so that the adhesive stripe is moved more than the width of the adhesive stripe during one wavelength. Thus, advantageously, the width of the adhesive free area between two adjacent adhesive stripes is equal to or more than a width of said adhesive stripes.

Advantageously, at least 50% of the adhesive coating 120, 121, preferably at least 70% of the adhesive coating 120, 121, more preferably at least 90% of the adhesive coating, and most preferably 100% of the adhesive coating is in the form of positionally alternating adhesive stripes, calculated as the total area of the adhesive on the linerless label (web) 100, 200. Thus, most advantageously, the adhesive coating 120, 121 consists of the positionally alternating adhesive stripes.

In order to avoid the telescoping problem, each adhesive stripe may need to be moved in the cross direction, during one wavelength (i.e. one oscillation cycle), equal to or more than the width of said adhesive stripe. Thus, an amplitude A1 of the wave is preferably greater than said width of the adhesive stripe.

Advantageously, the width of the adhesive free area (determined in the cross direction) between two adjacent adhesive stripes is equal to or more than a width of each said adhesive stripes, and the amplitude A1 of the wave is preferably greater than said width of the adhesive stripe.

In the novel solution, the adhesive and non-adhesive areas can vary during one circle around the linerless label roll. Further, the adhesive and non-adhesive areas may vary at the edge of the roll, i.e., the location of the adhesive stripes can vary at the edges of the rolls. Thus, the "slitting line" may cut through the positionally alternating adhesive stripe and not just between the adhesive stripes. Thus, the novel solution may improve the production efficiency of the linerless label (web) 100, 200. Further, thanks to the novel solution, some adhesives can be at the edge of the roll, without causing too much problem, e.g. for printers. In the customer roll, the varying adhesive areas at the edges of the roll also lower the internal pressure in the roll and provide additional area for the adhesive to "spread out" within the roll due to the internal pressure building between successive layers of the roll. This helps to avoid or minimize adhesive bleeding where adhesive becomes pushed out from the edges of the roll contaminating the sides of the roll and causing problems in the end use. This oozing or bleeding of the adhesive can be avoided by selecting "harder" adhesives, but this typically creates a compromise decreasing the other performance parameters of the adhesive. Thanks to the invention, the adhesive properties can be more freely selected and still the customer rolls are free from adhesive bleeding/oozing.

Thanks to the novel solution, smooth machines rolls as well as smooth customer rolls without telescoping problem may be provided. The novel solution may have several technical effects and advantages, such as at least some of the following:

- Smooth outer surface of linerless label rolls,
- No telescoping in the machine roll,
- No telescoping in the customer roll,
- No adhesive bleeding/oozing, even if there are some adhesives at the edges of the customer roll,
- Adhesive residue may be reduced in any parts contacting the web during manufacturing (coating, slitting) or end use (printer), and
- The solution may allow to slit any coil widths without specific adjustment.

If the locations of the adhesive stripes are varied in some other way, the rolls may still have issues with telescoping. By arranging adhesive coating 120, 121 in positionally alternating continuous adhesive stripes having a wavelength (i.e. oscillation cycled) in the longitudinal direction of the label web 100 (i.e. the first direction) and a positional amplitude in the cross direction of the label web (i.e. the second direction), performance of the manufacturing stages as well as performance e.g. in an on-demand printer as well as the manual handling of the label after printing may be significantly improved. The performance of the manufacturing stages may be significantly improved thanks to the positionally alternating continuous adhesive stripes because the telescoping problem of the linerless label rolls can be avoided. This may be further improved by using sinusoidal waveform for the positionally alternating adhesive stripes.

The pressure sensitive adhesive coating may be arranged on the second side 112 as positionally alternating continuous adhesive stripes in a first direction (i.e., longitudinal direction) of the web, having a minimum area of 10%, preferably 25%, more preferably 35% and most preferably 45% calculated from a total width of the label web. Further, the pressure sensitive adhesive coating may be arranged on the second side 112 as positionally alternating continuous adhesive stripes in a first direction (i.e., longitudinal direction) of the web, having a maximum area of 50%, more preferably equal to or less than 48% and most preferably equal to or less than 45% calculated from a total width of the label web.

Further, the total coverage of the pressure sensitive adhesive coating, calculated from the total surface area of the second side, may be equal to or more than 10%, more preferably equal to or more than 30%, more preferably equal to or more than 40%, and most preferably equal to or more than 45%, calculated from the total surface area of the second side. Further, the total coverage of the pressure sensitive adhesive coating, calculated from the total surface area of the second side, may be equal to or less than 50%, more preferably equal to or less than 48%, and most preferably equal to or less than 45%, calculated from the total surface area of the second side Referring to FIG. 3*a*, for some end uses, it may be essential to leave continuous adhesion-free areas/stripes 150*a* near the longitudinal edges of the label web 100. These adhesion-free areas/stripes 150, 150*a* near the longitudinal edges or on the longitudinal edges may correspond to minimum of 10%, or of 20% or even more than 30% of the total width of the label web 100. The rather wide non-adhesive area on the outer edges of the label prevent any bleeding of the adhesive in the label roll and aid keeping the printer mechanics clean. Thus, it may be possible to ease travel of the label inside the printer and/or to help to be able to grip the labels with fingers not touching the sticky PSA. However, thanks to the novel solution comprising positionally alternating adhesive stripes, the continuous adhesion-free areas near the longitudinal edges may not be needed at all.

The positionally alternating adhesive stripes in the linerless label (web) 100, 200 may provide good balance between tack and manual handling. The non-adhesive areas 150, 150*a* between the positionally alternating adhesive stripes may prevent any bleeding of the adhesive in the label roll and aid keeping the printer mechanics clean. Yet, the total PSA areas is wide enough to provide good enough traction in the printer rolls in order to traction the label through the printer.

In an embodiment, the adhesion-free area 150 and the positionally alternating adhesive stripe(s) 120, 121 adjacent to said adhesion-fee are 150 may both have a width in a range between 3 and 8 mm. Further, the width of said positionally alternating adhesive stripe may be equal to or less than the width of the adhesion-free area 150. This may provide good properties for the linerless label web as well as decrease or prevent the telescoping problem of the linerless label rolls.

In an embodiment, the linerless label (web) 100, 200 comprises adhesion-free areas 150*a* between two adjacent positionally alternating adhesive stripes, the adhesion-free areas having a width in a range between 1 mm and 25 mm, more preferably in a range between 2 mm and 15 mm, and most preferably in a range between 4 mm and 8 mm. Further, the width of each said positionally alternating adhesive stripe may be equal to or less than the width of the adhesion-free area 150.

Thanks to the novel solution, it is possible to obtain a linerless label (web) 100, 200 in a cost-effective manner, which linerless label (web) may have improved properties for the manufacturing process so that telescoping of linerless label rolls may be avoided. Still further, improved properties, for example, for printers as well as for the labelling purpose may be obtained.

Thus, as discussed, the novel linerless label (web) 100, 200 may have several advantages, such as avoiding telescoping problems of machine rolls as well as customer rolls during manufacturing process of the linerless label and improving production efficiency of the linerless label web while maintaining good (or even improved properties) for the end users.

Release Coating

The thermally printable face 110 can have a release coating 130 on the first side 111 of the face 110, i.e., top of the face 110, as illustrated in FIG. 1.

According to one embodiment, the release coating 130 is coated and cured on the top of the face 110 before either directly coating and drying the adhesive coating 120, 121 on the bottom of the face 110, or alternatively, before transferring the separately dried adhesive coating 120, 121 on the bottom of the face 110. In other words, preferably a readily release coated face 110 is provided into the process of adding adhesive coating 120,121 on the opposite side of the face 110. The benefit of these embodiments is that the release coating 130 may be provided as a completely separate step and potentially in completely separate facility.

Thus, the method for manufacturing a linerless label web may comprise the following step:

supplying the face 110 comprising a release coating.

According to another embodiment, the release coating 130 is added afterwards on the opposite side of the face 110. The benefit of this embodiments is that the release coating 130 is not undergoing any previous processing steps helping to avoid release agent contamination during those steps. On the other hand, the release coating 130 may need to be added in the same process because otherwise the adhesive coated web may not be self-wound into a roll.

Preferably, the face 110 is pre-coated with the release coating 130.

The separate release coating layer 130 may be used to improve the self-woundability of the linerless label. The linerless label web 100 with pressure sensitive adhesive 120 on its one side (bottom side) and release coating 130 on its other side (top side) can be self-wound around itself without tendency of blocking the adjacent layers of the label web 100 to each other.

The release coating 130, may be a silicone-based or non-silicone-based release coating. Preferably, the release coating comprises or consists of silicone-based release coating. PA silicone-based release coating 130 may comprise UV curable silicone, for example UV free radical silicone or cationic UV silicone. The release coating 130 may comprise one or more layers of release coating 130.

Non-thermally curable release coatings are preferable, for example UV curable silicone, because curing of such layers may not heat the substrate.

A further function of the release coating 130 may be that it may provide a lower friction level against a print head and/or against other mechanical components of the printer minimizing wear of those components and minimizing adhesive residue built up. Thus, in an example, the release layer 130 is used in order to lower friction against the print head of a printer.

In an embodiment, the adhesive coating 120,121 is either directly coated and dried on top of release coating 130, or alternatively, the separately dried adhesive coating 120, 121 is transferred on top of this release coating 130. In these embodiments, when the web is self-wound into a roll the pressure sensitive adhesive coating 120 becomes anchored onto the bottom side of the face 110 which is now without release coating. When unwinding the roll such linerless web has the adhesive coating 120 remaining now on the bottom of face 110 and the release coating 130 remaining on top of the face 110.

Linerless Label

A label 200 (also called as a linerless label or a label product) is a piece of material to be applied onto an article. Articles of different shapes and materials may be used together with the labels 200. An article may be a package. Properties and requirements for a label 200 may be different depending on the end use in question as described in Table 1.

A label 200 comprises at least the face 110 and an adhesive layer comprising or consisting of the positionally alternating adhesive stripe(s). A typical way to adhere the label 200 onto an article is by use of the PSA coating 120. Therefore, the adhesive coating 120 comprises pressure sensitive adhesive (PSA). A label 200 comprising pressure sensitive adhesive may be referred to as a pressure sensitive adhesive label. Pressure sensitive adhesive labels may also be referred to as self-adhesive labels.

The labels 200 comprising PSA can be adhered to most surfaces through an adhesive layer without the use of a secondary agent, such as a solvent, or heat to strengthen the bond. In that case, the adhesive is pressure sensitive as such. Alternatively, the adhesive may be activatable in order to be pressure sensitive. The PSA forms a bond when pressure is applied onto the label at ambient temperature (e.g. between 15 and 35° C.) or for cold applications even under freezing temperatures below 0° C., adhering the label to the item to be labelled. Examples of pressure sensitive adhesives include water-based (water-borne) PSAs, solvent based PSAs, and hot-melt PSAs. A label may, alternatively or in addition, comprise other adhesive(s).

In this application, the pressure sensitive adhesive has inherent pressure sensitivity without need for separate activation before being able to be dispensed onto an article to be labeled.

There are different kinds of labels in the market. A label may be so-called linerless label 200. The linerless label comprises a face 110 and an adhesive on the face 110. Alternatively, the label may be a so-called shrink label, where heat shrinkable polymeric face material(s) are seamed and rolled on or sleeved around labelled articles and shrunk around the items. Shrinkable labels may comprise additionally some pressure sensitive adhesive(s) or those may be produced completely without pressure sensitive adhesive, or even without seaming adhesive. Further, the label may be an activatable linerless label, wherein the adhesive is activatable to be pressure sensitive, using for example additional heat, moisture or other activation means.

In this application, the label is the linerless label. The linerless label can be attached onto the labelled item primarily via the pressure sensitive adhesive covering partially the bottom side of the label. The linerless label (web) of the invention is also of the tape-type, in other words it can be self-wound onto itself in a roll without need for additional release liner.

Labels may be used in wide variety of labelling applications and end-use areas, such as labelling of food, home and personal care products, industrial products, pharmaceutical and health care products, beverage and wine bottles, other consumables etc. Labels enable providing information, like product specification, on the labelled product(s). Information, e.g. print of a label, may comprise human-readable information, like image(s), logo(s), text, and/or machine-readable information, like bar code(s), QR (Quick Response) code(s). One subcategory of labels are so-called Variable Information Print (VIP) labels. These labels are at least partly printed just before dispensing them onto the item to be labelled and carry product specific information on that individual item to be labelled. VIP labels are used, for example, in retail weighting scales for fruits, vegetables, meat and other items sold per weight. Other labels which are individually printed per need are different type logistic labels containing shipment or product specific information, bus or train tickets or other tickets etc.

Advantageously, the linerless label (web) 100, 200 comprises the face and the positionally alternating adhesive stripes on the second side of the face. Thus, an improved linerless label may be formed, which may have improved properties.

In an advantageous example, the linerless label (web) consists of the following layers:

the face, the release coating on first side of the face, and one or more than one positionally alternating adhesive stripe on the second side on the face.

Linerless Label Web

FIG. 1 illustrates, by way of an example, an $S_x$,$S_y$-cross-section of a linerless label (web) 100, 200, which may be a linerless label web 100 or a single label 200.

A linerless label web 100 refers to structure comprising so called continuous face 110 and an adhesive 120 arranged on one side of the face 110. A linerless label web 100 is generally processed by moving over rollers. Between processing stages, the label web 100 may be stored and transported as rolls. From the linerless label web 100, individual labels 200 may be cut. During manufacturing process of customer rolls, the linerless label web 100 is wound into a machine roll, and the machine roll is unwound and slit into smaller customer rolls.

Machine Rolls and Customer Rolls

The linerless label roll may be so called machine roll 570, or a customer roll 300. In the manufacturing process of the linerless label, the linerless label is typically rolled into a machine roll. Width of the machine roll, (i.e., the linerless label web before it is cut into customer rolls), is typically a multiple of the final customer roll 300 width. The width of the machine may be, for example, from 1 to 3 meters.

A single machine roll may be arranged with positionally alternating continuous adhesive stripes in different cross-directional positions (adhesive stripe locations) and thus used to produce different type of customer rolls. The slitting process may, in some cases, be used to provide different adhesive stripe positions.

Typical machine roll diameter DMR is from 500 mm to 1500 mm, most typically from 500 mm to 1000 mm. Thus, the top layer of full machine roll may have a length, for example, from 1 m to 5 m.

A diameter DCR of a customer roll 300 may be, for example, between 50 mm and 150 mm. Thus, the customer roll 300 may be about 10 times smaller than the machine roll. Thus, the top layer of full customer roll 300 may have a length, for example, from 0.1 m to 0.5 m.

The linerless label web 100, after rolled into a customer roll 300, may be referred to as a (linerless label) customer product roll, customer roll or product roll. Depending on a diameter of the label roll and thickness of the linerless label material, a single roll may contain, for example, 10-100 meters of label material (i.e., linerless label web 100).

Typical linerless label web 100 customer roll 300 consisting of a single label width may have a width of approximately 10 to 100 mm. Quite commonly used widths can be found around in the middle of the aforementioned range, i.e. between 40-60 millimeters.

The face 110 may be arranged with multiple positionally alternating adhesive stripes. Afterwards, the wider web width of the machine roll produced in this manufacturing process may be to be slitted into a correct customer roll 300 width. The customer roll 300 may have one or more than one positionally alternating adhesive stripe, such as several positionally alternating adhesive stripes.

Total PSA coverage in a cross-direction, i.e. the second direction, of a label web 100 of a customer roll 300 may be less than 50%, preferably equal to or less than 48%, and most preferably equal to or less than 45%. PSA may be arranged in one or more than one positionally alternating continuous adhesive stripes leaving one or more adhesion-free area(s) 150 between the stripes. Thus, a width of the adhesion-free area between two positionally alternating adhesive stripes is advantageously equal to or more than a width of each adhesive stripe adjacent to said adhesion-free area.

Further, according to one embodiment and referring to FIGS. 2*a* and 3*a*, the linerless label (web) may comprise one or several areas along the longitudinal (machine direction) edges without adhesive to further prevent oozing of the adhesive out from the sides of a label roll and/or aiding the manual gripping of the label from the edge without touching the sticky adhesive. The non-adhesive areas 150, 150*a* of the linerless label (web) 100, 200 may also help to minimize building adhesive residue inside the printer or guillotine mechanisms.

The linerless label (web) 100, 200 may comprise one or more properties from a group comprising:

Coat weight of adhesive layer 120 can be in the range of 15-20 g/m$^2$ (dry coat weight) in order ensure both; good anchorage and good tack to different type of surfaces.

Adhesive layer 120, 121 is preferably water-based adhesive layer.

Further, acrylic based adhesives are more environmentally friendly and also provide more suitable temporal build-up of the final tack helping to reduce contamination of the printer.

Adhesive layer 120, 121 is arranged in positionally alternating adhesive stripe(s) in longitudinal direction. This ensures suitable label behavior per given end use but also helps to reduce the contamination of the printer. Further, this can prevent telescoping problem of machine and customer rolls. The positionally alternating adhesive stripe(s) may have a shape of a sinusoidal wave.

optionally, no special primer between the thermal paper and PSA to enhance adhesive anchorage of the adhesive onto the thermal paper. High enough anchorage may be achieved by using high enough coat weight of the adhesive and fully drying the adhesive. This streamlines the manufacturing leaving out one additional processing phase and helping to lower the cost.

Water-based acrylic adhesive provides less aggressive first tack meaning that after being opened from the label roll, the immediate tack of the PSA when guided through the printer is less aggressive compared, for example to hot melt-based PSAs. This helps, together with other features of the label, to minimize the adhesive residue build up inside the printer. The final tack builds up only after the label has been dispensed and left on the labelled item for a longer time. The label might even be removable over a certain period of time (minutes), before building a more permanent type of tack. Specific properties of PSA naturally depending on the exact formulation of the adhesive and surface materials to be labelled.

There are multitude of requirements placed on the linerless label product in order to provide cost-efficient, efficient, and trouble-free operation in a user friendly and sustainable manner.

The adhesive free areas may decrease manufacturing costs, be good for the environment, and prevent an accumulation of the adhesive coating 120 to a blade and rolls of the linerless label printer. However, the adhesive stripes may cause telescoping problem during the manufacturing process of the linerless label. The linerless label (web) according to the specification may reduce the manufacturing problems caused by the adhesive stripes on the surface of the face. Thanks to the novel solution, the telescoping of linerless label (web) may be prevented while still providing advantages obtained by using the adhesive stripes.

Manufacturing Methods

The positionally alternating adhesive stripes may be manufactured e.g. by using at least some method steps and/or units described in this specification.

The FIGS. 4*a* to 8 and 10 to 11 illustrate some example steps and units for manufacturing the linerless label (web).

The positionally alternating adhesive stripes 120, 121 may be applied and dried directly on the face 110. Alternatively, the positionally alternating adhesive stripes 120, 121 may be first applied and dried on a separate carrier and only then transferred onto the face 110. The benefit of the former method is having less manufacturing steps but on the other hand requiring arrangements not to overheat the face material in case of a thermally sensitive face material. The benefit of the latter is to be able to perform the drying phase more freely but on the other hand requiring additional processing steps to transfer the dried adhesive onto the face 110.

During a manufacturing process of the linerless label (web) 100, 200, the adhesive coating 121 comprising or consisting of the positionally alternating adhesive stripes is dried into a pressure sensitive adhesive coating 120. Advantageously, the positionally alternating adhesive stripe(s) comprise(s) water-based acrylic adhesive.

The manufacturing process of the linerless label (web) 100, 200 may comprise an actuator which may oscillate to form the positionally alternating adhesive stripe(s). The actuator may be moving at least in a cross-direction CD of the web while forming the positionally alternating adhesive stripes. By moving the actuator continuously in an oscillating manner, the location of the adhesive stripes in the machine roll can be controlled and, hence, the machine rolls may have a smooth roll profile.

The actuator may oscillate while the linerless label web is running, hence, the actuator may cause the predetermined form of the positionally alternating adhesive stripes. The actuator is preferably making at least the cross directional moving.

An oscillation frequency of the oscillating actuator and a speed of the substrate can be optimized in order to obtain predetermined positional amplitude and positional frequency for adhesive stripes.

One complete oscillation the actuator may form one oscillation cycle of the positionally alternating adhesive stripe. The actuator can have a such oscillation frequency and amplitude that the telescoping of machine rolls as well as telescoping of customer rolls can be prevented.

The frequency refers to number of oscillations in one time unit. In this application, the frequency refers to number of oscillations in one second. Thus, the frequency refers to a number of oscillations the actuator is making per second during the manufacturing step of the adhesive stripes.

Frequency of the actuator during the manufacturing step of the positionally alternating adhesive stripes may be, for example, in a range 0.1-10 Hz, for example 0.5-1.5 Hz. The frequency is selected based on the speed of the web but there are upper limits which are usable because the fluidic adhesive cannot be coated in positionally alternating manner reliably and reproductible at any frequency. With the given fluidic properties of the adhesive to be coated (for example viscosity), the preferred frequencies for the actuator movement are around 1 Hz, for example 0.5-1.5 Hz. If the movement is made faster, the adhesive may experience, for example, a ploughing effect where the edges of the adhesive stripes begin to accumulate increased thickness as the actuator pushes the adhesive sideways faster than the viscosity of the adhesive would allow. These either reflect in the quality of the adhesive coating (uneven thickness of the adhesive stripes) or they may also lead to web brakes.

If the actuator moves too fast, the manufacturing process may be very challenging due to the aforementioned fluidic properties of adhesives, particularly in case of water based acrylic adhesives. However a fast moving mechanical items in very close or contact proximity of a fast moving web may cause also other mechanical kind of problems such as vibrations, which also could lead to web brakes.

In an advantageous example, the web moves from 0.5 to 10 meters during one oscillation cycle, preferably from 2 to 7 meters, and most preferably from 3 to 5 meters during one oscillation cycle. Thus, advantageously, the positionally alternating adhesive stripe has a wavelength in a range between 0.5 m and 10 m, preferably in a range between 2 m and 7 m, and most preferably in a range between 3 m and 5 m. The positional wavelength WL refers to one oscillation cycle of the positionally alternating adhesive stripe.

In an embodiment, the substrate is moved, during one oscillation cycle of the actuator, in a range between 3 m and 5 m. Thus, in an embodiment, the positionally alternating adhesive stripe has a wavelength in a range between 3 m and 5 m.

The characteristic time of the actuator that it takes to make one oscillation cycle may be called as a period P1 of oscillation. As the substrate (the face or the carrier material) moves by, in a time equal to the period of one oscillation of the actuator, the substrate has moved along a distance equal to the wavelength WL. Thus, the obtained wavelength may depend on both, the speed of the substrate and the frequency of the actuator.

The actuator may be:

Pneumatic actuator, i.e., an actuator using compressed air. The pneumatic actuator may be moving at least forward and backward in the cross direction. The pneumatic actuator may be particularly suitable to form adhesive stripes having a shape of a sinusoidal wave.

Hydraulic actuator. The hydraulic actuator may be moving at least forward and backward in the cross direction. Speed and direction of movement may be controlled. The hydraulic actuator may be used to form different kind of shapes.

Electronic actuator. The electronic actuator may be moving at least forward and backward in the cross direction. Speed and direction of movement may be controlled. The electronic actuator may be used to form different kind of shapes.

Thus, all actuators may move at least forward and backward. Further, for example, the hydraulic and electronic actuators may be moved to any direction. In an advantageous example, a speed and a movement of the actuator may be controlled. In an embodiment, the actuator may be moved to any direction The actuator may be, for example, based on threaded rod being rotated with a motor and a nut travelling on the threads and linked to move the coating apparatus in cross-direction of the web. In the simplest form the rotational speed of the motor is adjusted to affect the positional frequency and the threaded rod is equipped with limiters which change the direction of the rotation and make the nut to travel back and forward the given distance. Adjusting this distance changes the positional amplitude.

Instead of basic mechanical actuator any hydraulic or electronic linear drive or other system can be used to create the cross-directional movement necessary to move the coating apparatus respect to the running web. In principle, even a special gravure roll could be utilized for the coating process, but such a coating method is not easily adjustable to achieve a predetermined positionally alternating coating per need.

The waveforms produced by the predetermined selection of the positional frequency and the positional amplitude of the stripes may range from smoothly varying sinusoidal waveforms into more sharply changing, almost stepwise changing waveforms. All of these can however be characterized with having a certain positional main frequency and main amplitude behavior.

The actuator may be "mechanically controlled" adjusting the speed and travel of, for example, the threaded rod as explained above or altering pneumatic or hydraulic fluid flow and limiter valve positions in a pneumatic or hydraulic cylinder. On the other hand, any waveform can be achieved with "computer or electronically controlled" systems which may change the speed of motors, hydraulic flows, or drive arrangements for electric linear drives.

For cost reasons, the actuator is preferably the pneumatic actuator being capable of fast enough movements and capable of being "mechanically controlled" and adjusted. Most preferably, the actuator is the pneumatic actuator which can move forward and backward so that the amplitude and the frequency of the actuator can be controlled.

Machine speed of the adhesive coating process may be, for example, 100-600 m/min. Thus, a speed of the substrate (such as the face) may be in a range between 100 m/min and 600 m/min when the oscillating actuator is forming the positionally alternating adhesive stripe(s) by applying the adhesive in order to form the positionally alternating adhesive stripes or by removing adhesive in order to form the positionally alternating adhesive stripes.

The oscillating actuator may apply the adhesive coating. In this embodiment, the oscillating actuator may comprise a nozzle. Further, the oscillating actuator may comprise blocking shims 870 (shown in FIG. 8) forming the positionally alternating adhesive stripes and the non-adhesive areas between the adhesive stripes.

Alternatively, the oscillating actuator may remove at least some of the adhesive coating. Thus, the oscillating actuator may comprise a blade which removes at least part of the adhesive coating in order to form the positionally alternating adhesive stripes on the surface of the face. Depending on the predetermined positioning of the adhesive stripes and optimizing the result, the blade may be moved at different frequencies in the cross direction. In this embodiment, the removal of the adhesive coating may be implemented, for example, by a wiping blade, wherein the blade may be arranged at a wiping angle of 75-85 degrees with respect to the surface of the substrate.

As discussed, the adhesive coating 120, 121 comprises positionally alternating adhesive stripe(s) and adhesive free areas between the adhesive stripes. Advantageously, the adhesive covers between 10% and 50% of the total area of the face 110, more advantageously, the adhesive covers between 30% and 50% of the total area of the second side of linerless label.

The adhesive may be arranged as "oscillating" stripes along the longitudinal direction (i.e. the first direction) of the label web 100. Thus, in transversal direction (i.e. in second direction) of the label web 100 the face 110 may comprise alternating areas with and without adhesive.

Arranging adhesion-free stripes/areas 150, 150*a* along the label web 100 may be of help in manual handling and/or dispensing of the label. Further, arranging adhesion-free stripes/areas along longitudinal edges of the label web 100 as shown in FIGS. 2*a* and 3*a*, may be advantageous from the printer point of view. Therefore, contamination of the printer parts by the adhesive may be at least diminished. Finally, from the economic and environmental point of view it is favorable to provide the label 200/label web 100 with the adhesive solely on parts of the label necessary for providing the desired adhesion.

Figure 4A:
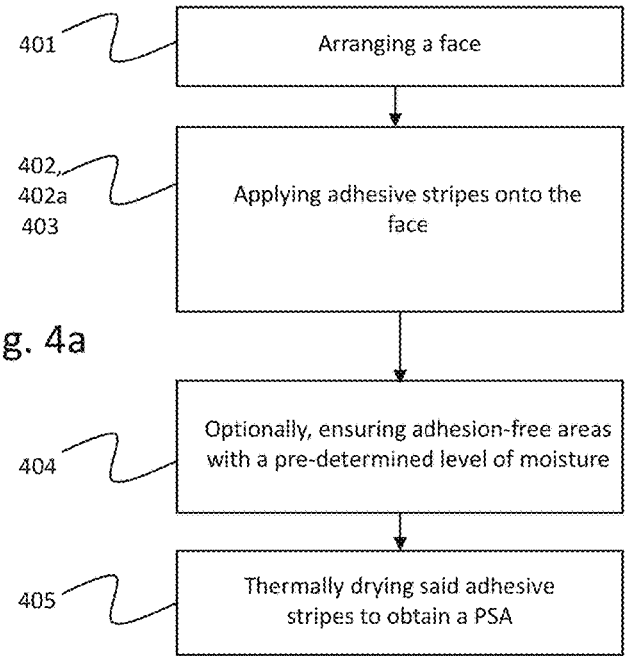
FIG. 4*a* illustrates, by way of an example, method steps according to embodiments.

According to an embodiment illustrated in FIG. 4*a*, a method for manufacturing a linerless label web 100 comprising positionally alternating adhesive stripe(s) is provided. The method comprises arranging a face (step 401), applying positionally alternating adhesive stripes 121 onto the face (step 402, 403), optionally ensuring the adhesion-free areas 150 with a pre-determined level of moisture (step 404), and thermally drying the positionally alternating adhesive stripes into the pressure sensitive adhesive 120 (step 405). Steps 402-404 of the method may be performed simultaneously or stepwise. The positionally alternating adhesive stripes may be arranged by applying the adhesive directly in a form of positionally alternating adhesive stripes, or by applying continuous adhesive layer and then removing part of the adhesive to form the adhesive stripes.

Figure 5:
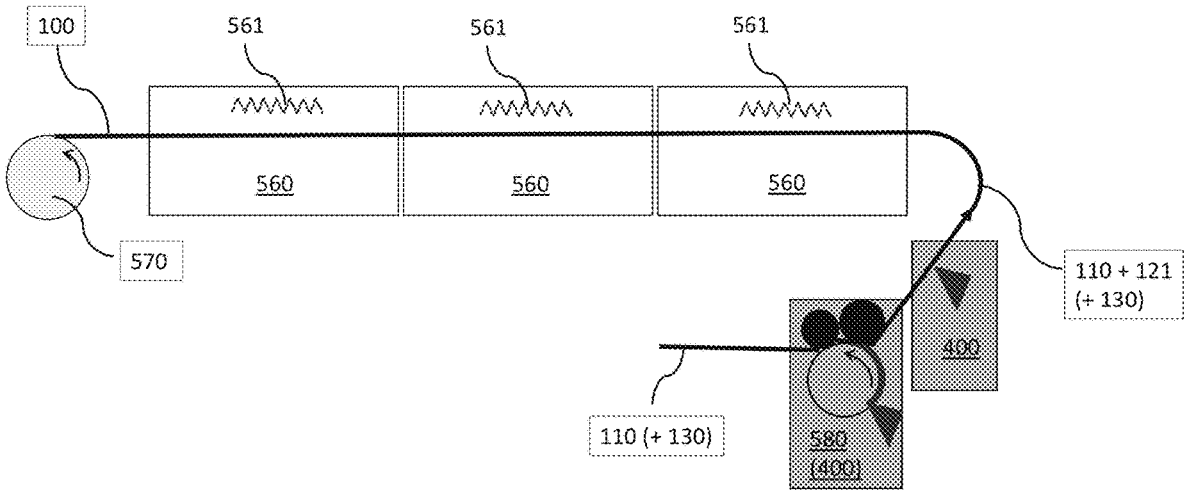
FIG. 5 illustrates, by way of an example, an embodiment of a manufacturing method and an apparatus.

FIG. 5 illustrates an apparatus according to an embodiment. The apparatus comprises a coating unit 580 for applying the adhesive coating 121 onto a face 110. Downstream of the coating unit 580 the apparatus may comprise a unit 400 for adhesive removal. The unit 400 for adhesive removal may be the oscillating actuator. Downstream of the unit 400, the apparatus comprises at least one drying unit 400 for drying the positionally alternating adhesive stripes 121. The drying unit comprises at least one drying device 561. After the drying unit(s) the thus formed linerless label web 100 is arranged to be rolled onto a linerless label web roll 570.

In an embodiment, the positionally alternating adhesive stripes are provided by first applying the adhesive coating 121 onto 100% area of the face 110 by the coating unit 580. After that the oscillating actuator may remove some of the adhesive coating 121 from the face 110 so as to provide the face 110 with alternating adhesion areas and adhesion-free areas 150 in the transversal direction of the face 110, hence, forming the positionally alternating adhesive stripes. Removing of the adhesive is performed before drying the adhesive in at least one drying unit 560. Removing of the adhesive may be performed by a unit 400, which, in this embodiment, can be the oscillating actuator.

Thus, the method can comprise the following step:

Providing one or more than one positionally alternating adhesive stripe by removing at least some of the adhesive coating by an oscillating actuator before the adhesive coating is dried into the pressure sensitive adhesive coating.

Particularly, the method may comprise the following step(s):

applying adhesive coating on a substrate, which may be a face or a carrier material, removing at least 50% of the adhesive coating from the substrate area by using an oscillating actuator to provide adhesion-free areas and one or more than one positionally alternating adhesive stripe.

In this embodiment, the oscillating actuator may comprise a wiping blade, wherein the blade is preferably arranged at a wiping angle of 75-85 degrees with respect to the surface of the substrate.

Applying the adhesive coating 121 onto 100% area of the face 110 provides the effect that also the areas wherefrom the adhesive is removed later on, will get moistened by the water contained by the adhesive. This may be particularly advantageous because, thanks to the positionally alternating adhesive stripes, it might be difficult to apply moisture only to the areas between the adhesive stripes. When applying adhesive coating 121 onto full area of the face 110, water is absorbed into the face 110 and small amount of adhesive is remaining on the face 110 after forming positionally alternating continuous adhesive stripes, also on the areas wherefrom the adhesive has been removed.

Residual amount of the adhesive on the adhesion-free area may be about 0-5.0 g/m$^2$, such as from 0.5 g/m$^2$ to 2 g/m$^2$, or from 2.0 g/m$^2$ to 5.0 g/m$^2$. In an embodiment, the adhesion-free areas may comprise a residual amount of the adhesive coating in a range between 0 and 0.5 g/m$^2$. In another embodiment, the adhesion-free areas may comprise a residual amount of the adhesive coating in a range between 0.5 g/m$^2$ and 5 g/m$^2$. In a preferred embodiment, the adhesion-free areas may comprise a residual amount of the adhesive coating in a range between 0 g/m$^2$ and 1 g/m$^2$, or in a range between 0.1 g/m$^2$ and 1 g/m$^2$. However, the residual amount of the adhesive is so small, that after drying it does not provide significant adhesion properties, and thus is called adhesion-free.

Therefore, advantageously, the adhesion-free areas may comprise some moisture because part of the adhesive has been removed and the areas wherefrom the adhesive is removed are moistened by the water from the adhesive coating.

Thus, in an embodiment, the adhesive coating is applied on to a substrate, which is a carrier material, and then thermally dried into the pressure sensitive adhesive coating on the carrier material, after which the pressure sensitive adhesive is transferred from the carrier material onto the face.

Thus, said adhesive coating may be applied onto the second side of the face, or the pressure sensitive adhesive coating may be transferred from the carrier material onto the second side of the face.

In an embodiment, said adhesive coating is first applied on to the face, and then thermally dried into the pressure sensitive adhesive coating on the face. The adhesive coating 121 may be applied onto the face 110 using a contact coating method, such as a roll coating.

In an embodiment, the adhesive coating 121 is applied by a direct gravure coating. In the direct gravure coating, the adhesive transfer takes place directly from the gravure roll to the substrate, such as the face 110.

Part of the adhesive may be removed from the face by using the oscillating actuator comprising e.g. a blade, such as a nylon blade. The blade may be called as a doctor blade. The blade may refer to any means suitable for removing adhesive from the web. The blade has the effect that while removing the adhesive, the blade simultaneously provides pressure to the face 110, thus pushing moisture, i.e. water contained by the adhesive into the face 110. Further, the oscillating movement of the actuator provides the positionally alternating adhesive stripes, each oscillation cycle of the positionally alternating adhesive stripe having an amplitude and a wavelength.

Dry weight content of the adhesive coating 121 that is removed from the web, i.e. the face 110, may differ from dry weight content of the adhesive coating 121 applied onto the face 110. The dry weight content of the adhesive coating 121 removed from the web may be e.g. from 0.1% to 5.0% lower compared to the dry weight content of the adhesive coating 121 applied onto the web. In an example, the dry weight content of the adhesive coating 121 removed from the web is from 0.5 to 1.0% lower compared to the dry weight content of the adhesive coating 121 applied onto the web. The residual amount of the adhesive coating 121 on the adhesion-free areas 150 together with the moisture transferred from the adhesive coating 121 to the face 110 have the effect that increase of the temperature of the substrate may be prevented, which may advantageous particularly in a case the face comprises of a direct thermal coating.

In an embodiment wherein the face is thermally printable, a certain target level of moisture may be ensured to be present on all parts/areas of the linerless label web 100 before the web enters into the drying phase. During the drying phase, the evaporation of that moisture maintains the web temperature below the activation temperature of the thermal coating both in the areas without adhesive/adhesion as well as areas with water-based adhesive/adhesion.

Figure 6:
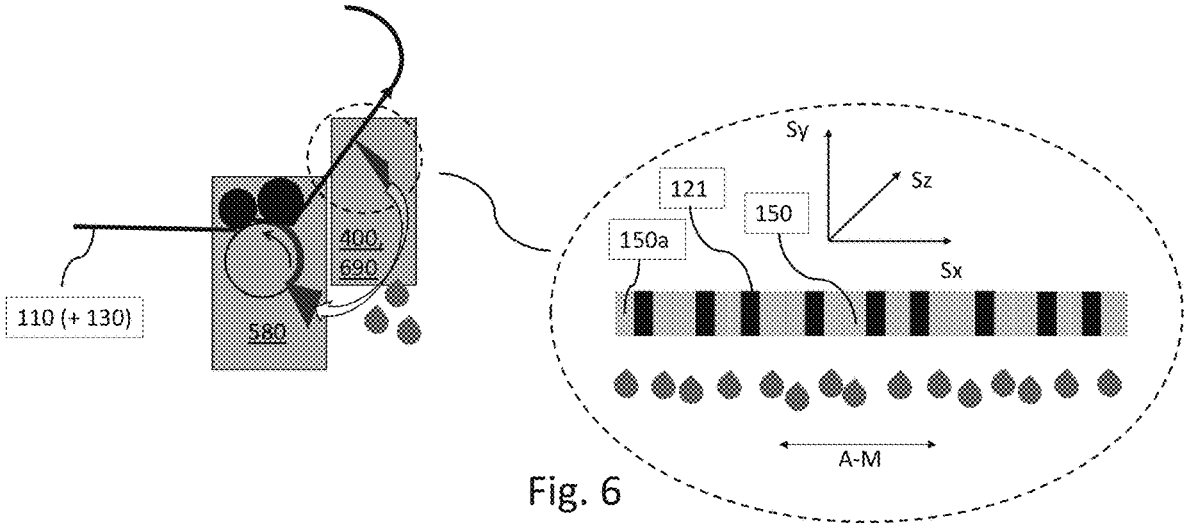
FIG. 6 illustrates, by way of an example, a detail of a manufacturing method and an apparatus according to an embodiment.

FIG. 6 provides a detailed view of a method and an apparatus according to an embodiment. The adhesive coating 121 is applied onto 100% area of the face 110 by the coating unit 580. After that, some of the adhesive coating 121 is removed from the face 110 by using the oscillating actuator 400, 690 so as to provide the face 110 with alternating adhesion stripes and adhesion-free areas 150. A unit 690 in said FIG. 6 can be the oscillating actuator 400, which can be arranged to remove the adhesive coating 121, visualized as black blocks 121 in dashed enlargement of FIG. 6. The dashed enlargement illustrates the face having the adhesive coating thereon in Sx,Sz-plane. Grey droplets of FIG. 6 illustrate the adhesive coating removed from the face 110 by the oscillating actuator 400. Adhesive removed from the face 110 may be collected and returned back to the coating unit, as illustrated by the curved arrow between the unit 400, 690 and the coating unit 580.

According to an embodiment, the oscillating actuator comprises a blade that is arranged at an angle of almost 90° with respect to the web, i.e. the face 110. The blade may be arranged at a wiping angle of from 75 to 85°, for example of 80°, with respect to the web. The blade may be arranged in forward direction with respect to the web. The web tension may be e.g. 100-250 N/m. The web tension may be, for example, 150 N/m. A higher web tension and/or a higher wiping blade angle may be responsible for providing pressure to the face 110, thus pushing more water contained by the adhesive coating 121 into the face 110 while removing the adhesive. Web tension and blade angle also have effect to the amount of the adhesive removed from the face 110. Higher web tension and/or blade angle may be responsible for higher amount of adhesive to be removed from the face 110. The moisture can be particularly useful if the linerless label (web) 100, 200 is thermally printable.

Distance between applying the adhesive coating 121 and removing the adhesive coating 121 may be for example from 20 cm to 1 m. Dwell time between applying the adhesive coating 121 and removing the adhesive coating 121 may be for example from 0.05 to 3 seconds. In an advantageous example, the machine speed of the process is in a range between 150 m/min and 250 m/min, and the distance between applying the adhesive coating 121 and removing the adhesive coating 121 is in a range between 30 cm and 90 cm. Thus, the dwell time between applying the adhesive coating 121 and removing the adhesive coating 121 is preferably between 0.1 and 0.5 seconds. The longer the distance between applying the adhesive coating 121 and removing the adhesive coating 121, i.e. the distance between the coating unit 580 and the oscillating actuator 400, 690 and/or the dwell time, the longer the time for the adhesive to be in contact with the face 110, and thus the higher the moisture content transferred from the adhesive coating 121 to the face 110.

Figure 7:
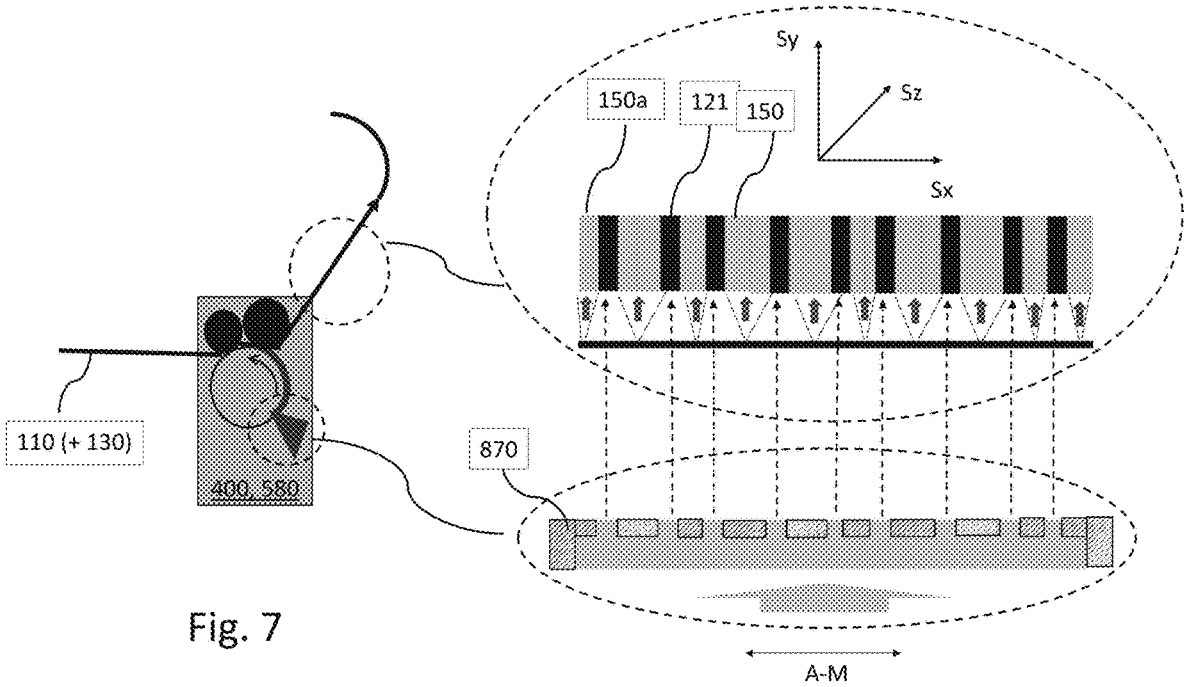
FIG. 7 illustrates, by way of an example, a detail of a manufacturing method and an apparatus according to an embodiment.
Figure 8:
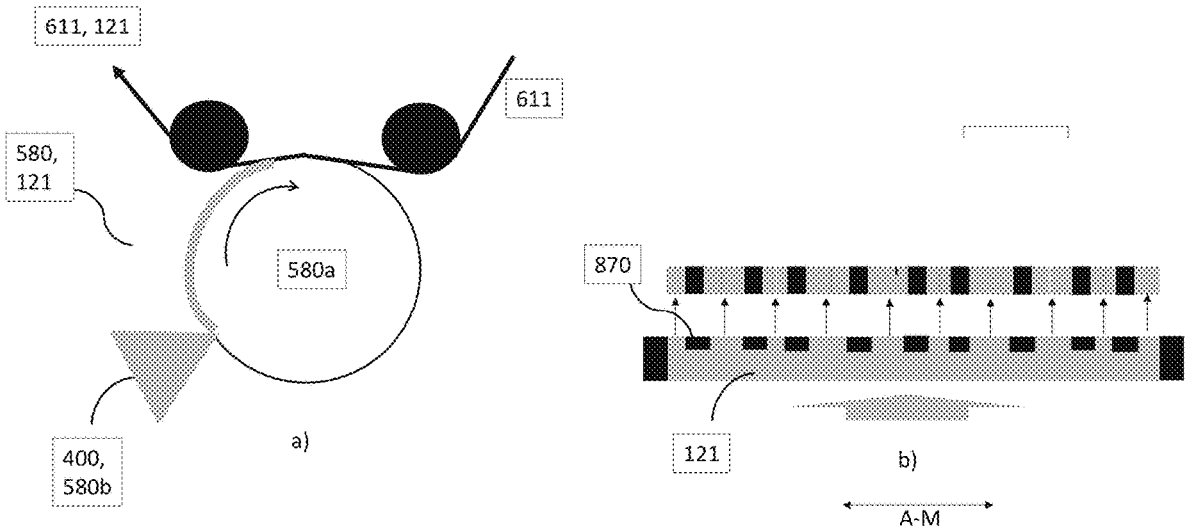
FIG. 8 illustrates, by way of an example, a detail of a manufacturing method and an apparatus according to an embodiment.

In an embodiment, and as illustrated in FIGS. 7-8, the positionally alternating adhesive stripes can be provided applying the adhesive coating 121 only locally onto the face 110 so as to provide the face 110 with alternating adhesion areas 121 and adhesion-free areas 150 in the transversal direction of the face 110. Said figures only shows the principle of the method, and the shape of the adhesive stripes is not shown in these figures. In this embodiment, the coating unit 580 is the oscillating actuator 400. Thus, the face 110 will get the positionally alternating adhesive stripes 121. The adhesion areas are visualized as black blocks in FIG. 7.

Referring to FIGS. 7-8, the positionally alternating adhesive stripes 121 may be applied directly onto a substrate. Said substrate may be the first side of the face or the second side of the face. Alternatively, the substrate may be a carrier material and the pressure sensitive adhesive coating may be transferred from the carrier material onto the first or second side of the face. After rolling the linerless label web into a roll, the PSA coating will become anchored to the second side (i.e., the bottom side) of the face material, no matter whether the adhesive coating was applied or transferred on the first side or the second side of the face.

As illustrated in dashed enlargements of FIG. 7, the adhesive coating 121 may be coated onto the face 110 in continuous parallel stripes running in machine direction of the label web 100. Further, thanks to the oscillating actuator, the parallel stripes can have a positionally alternating form as shown in FIGS. 2*a* and 3*a*.

In an embodiment, the adhesive may be applied by using a contact coating method, such as roll coating, wherein the adhesive is coated onto a transfer roll using a nozzle. The nozzle may be arranged with blocking shims (seen as blocks filled with slanted lines in FIG. 7) allowing the adhesive coating 121 to be delivered only onto certain cross-directional positions on the transfer roll. Therefore, the adhesive coating 121 on the face 110 also becomes positionally alternated. The width of adhesive may be changed per need by adjusting or changing the blocking shims in the nozzle. In this embodiment, the oscillating actuator comprises said nozzle forming the positionally alternating adhesive stripes.

In an embodiment, and as shown in FIG. 8, a transfer roll 580*a* of a coating unit 580 can be coated with an adhesive 120 using a coating nozzle 580*b*. The adhesive 120 from the transfer roll 580*a* surface is picked up onto the carrier web 611 forming adhesive coated carrier 611. The nozzle can oscillate is order to from positionally alternating adhesive stripes. The coating nozzle 580*b* may be arranged with blocking shims 870 allowing adhesive to the delivered only on certain cross-directional positions of the transfer roll 580*a*. Therefore, the adhesive coating 121 on the carrier 611 becomes also positionally alternated. Thanks to the oscillating movement of the nozzle, the adhesive coating is in a form of positionally alternating adhesive stripe(s). The position of adhesive may be changed per need by adjusting or changing the blocking shims 870 in the nozzle 580*b* and/or by adjusting the oscillating frequency of the nozzle.

An Example of a Drying Step

The positionally alternating adhesive stripes 121 may be dried on the face 110 or on the carrier 611. As a result of the drying, the pressure sensitive adhesive 120 is obtained. Preferably, the positionally alternating adhesive stripes are dried on the face 110. This may improve an easiness of the manufacturing process and, further, at least in some cases, improve production efficiency of the manufacturing process.

Drying comprises heating. Selection of the heating method affects the balance between radiative and convective heat transfer. The adhesive 121 may be dried into the PSA by using at least one of the following: infrared energy, microwave energy or air blow. Preferably the adhesive 121 is dried by air blow or by air blow together with another type of drying. This ensures suitable level of pre-heating of the adhesive to start the evaporation of the moisture from the adhesive but preventing the skinning of the adhesive top surface that would block the moisture from escaping out deeper from the adhesive layer. The drying phase of the machine comprising the drying unit(s) may have a total length of between 20 and 30 meters. The adhesive coating 121 may be dried in at least one drying unit 560.

After drying of the adhesive, the face 110 with the pressure sensitive adhesive thereon, i.e. the linerless label web 100 is wound onto a machine roll 570.

Adhesive applied on to a face 110 comprising paper may penetrate onto the face 110 and soften the face 110 or weaken hydrogen bonds in it. Thus, the paper face 110 may lose its qualities, which in turn may prevent further steps of label processing, like printing or die-cutting. In case of a plastic face 110, drying water-based adhesive applied on a face 110 has not been possible or has posed problems. For example, polypropylene or polyethylene have not been suitable label face 110 materials with a water based adhesive due to the high temperatures required in drying section which may cause melting or deformation of these filmic materials. The challenges are even more severe with thinner plastic film thicknesses which are a trend in order to save material and improve sustainability via lesser use of plastic materials.

Figure 4B:
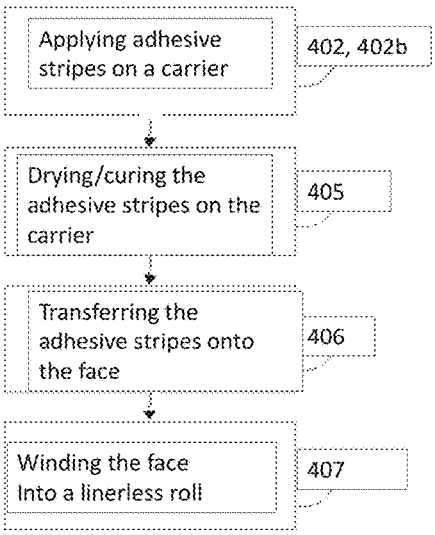
FIG. 4*b* illustrates, by way of an example, method steps according to embodiments.

According to an embodiment, the adhesive for the linerless label web is dried separately on a carrier material 611, before attaching the adhesive onto a face of the label. This avoids problems arising from heat sensitivity and enables usage of environmentally friendly water-based adhesives in such linerless labels. This approach allows a wider selection of substrate materials for the labels including substrate or coating materials even with lower physical or chemical performance but still fully valid for on-demand linerless printing and short-lived label applications FIG. 4*b* illustrates a method according to an embodiment. This method allows applying a PSA on a sensitive linerless face and forming a linerless label web 100 without exposing the face 110 to high temperatures. Steps 402-407 may also be called phases or stages.

It should also be understood that the adhesive coating methods and drying methods explained earlier in this specification are also applicable in the following embodiments.

Water-based adhesive is preferably used in the following embodiments. The adhesive is preferably water-based acrylic adhesive for reasons discussed in this specification.

In the following, two alternative approaches for the manufacturing method are described in more detail referring to FIGS. 10 and 11. The main difference between these two methods is how the carrier material 611 used for drying the adhesive coating is arranged. According to an embodiment schematically described in FIG. 10, the carrier material is arranged to be an endless belt. According to another embodiment schematically described in FIG. 11, the carrier material is arranged to be a reusable batch of a web material.

The adhesive coating 121 is in the first step 402*b* applied on a carrier material 611 by using an oscillating actuator, such as an oscillating nozzle. Then, in the second step 405, the adhesive coating 121 is dried/cured into PSA 120 on the carrier material 611 by conveying the carrier through a drier. The dried water-based adhesive 120 is transferred onto a face 110 of a label web 100 in the third step 406. Finally, the face with the pressure sensitive adhesive is wound into a roll of a linerless label web 100 in the fourth step 407. In this embodiment, the drying/curing of the adhesive coating 121 takes place on a separate carrier material 611 and therefore the face is not exposed to temperatures exceeding the activation temperature of said he thermally sensitive coating.

The carrier material 611 may be a belt 611*a*, for example a silicone belt, a plastic belt, such as a nylon belt, or a metal belt, such as a steel belt. Alternatively, the carrier material 611 may be a batch of a web material 611*a*, wherein the carrier material 611, 611*b* may be a filmic web material, preferably a polyethylene terephthalate (PET) web or other thin filmic material tolerating the drying temperatures. The belt may comprise a closed surface. An external surface of the belt may comprise roughness of 0.2-3.0 pm, preferably 0.4-1.0 pm, according to PPS 10 of ISO 8791.

The positionally alternating adhesive stripes may be in contact with the belt for at least 1 s, or 1.5 s, preferably at least 1.8 s, or at least 2.0 s, and preferably no longer than 10-20 s, and most preferably not longer than 8 s, to ensure efficient manufacturing process. Thickness of a metal belt may be for example 0.2-4.0 mm, preferably 1-2 mm. The density of the metal belt at the temperature of 20 degrees C. may be 7500-8500 kg/m$^2$, preferably 7700-8050 kg/m$^2$ to ensure high enough heat capacity for efficient thermal transfer and heating. Roughness of the belt coating may be 0.2-3.0 pm, preferably 0.4-1.0 pm, according to PPS 10 of ISO 8791. The thermal conductivity of the metal belt at the temperature of 20 degrees C. may be for example 13-21 W/mK, or 14-15 W/mK. The thermal conductivity of the metal belt at the temperature of 100 degrees C. may be for example 14-22 W/mK, or 15-16 W/mK.

For the purpose of this specification, in the following the terms "carrier" and "carrier material" may refer either to an endless belt or to a batch of a web material. The carrier 611 may comprise at least one release coating.

The adhesive coating 121 may be dried on one or both sides of the carrier, i.e. above and/or under the carrier. The adhesive coating 121 may be dried directly and/or indirectly. Drying may be implemented indirectly by heating the carrier.

Figure 10:
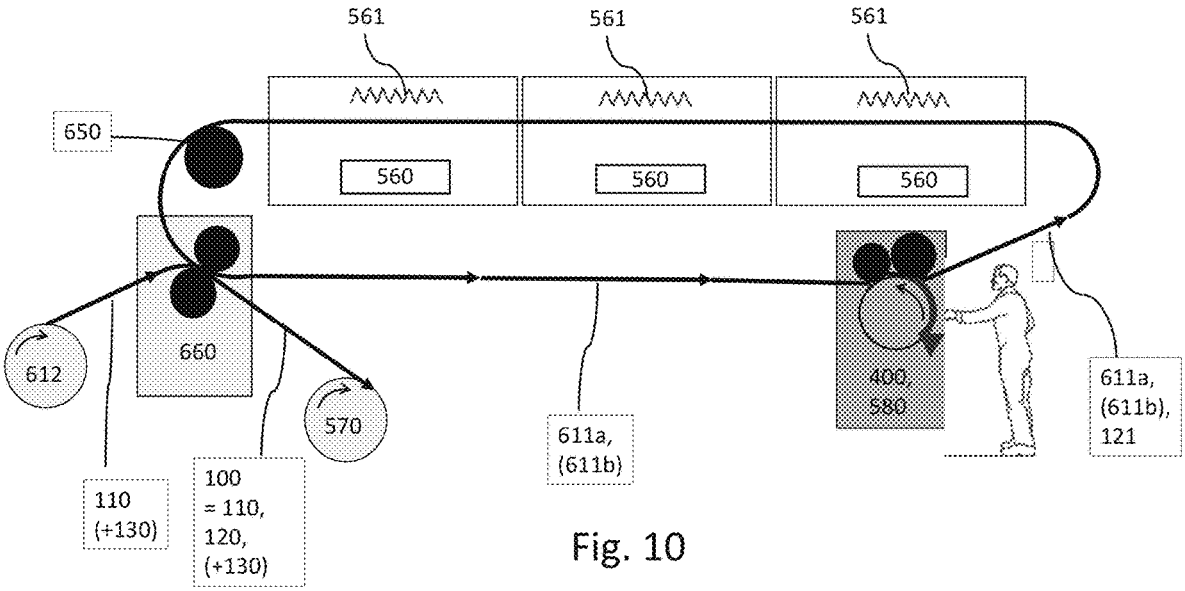
FIG. 10 illustrates, by way of an example, an embodiment of a manufacturing method and an apparatus.

FIG. 10 illustrates an apparatus according to an embodiment. The apparatus comprises a carrier material 611 in a form of a belt 611*a*. The adhesive 121 is applied onto the belt 611*a* by a coating unit 580, which can be the oscillating actuator 400, preferably comprising a nozzle. The coating unit 580 is arranged to apply the adhesive 121 onto the belt. Drying may be implemented by one or more drying device(s) 560, 561.

The apparatus in FIG. 10 comprises an unwinder 612 for the face 110. The face 110 may be in form of a web wound to a roll. After dried, the adhesive 120 may be attached to the face 110. The unwound face 110 and the dried water-based adhesive on the belt 611 can be attached in a nip 660, thereby forming a linerless label web 100. The formed linerless label web 100 is wound up to a roll 570. The label web roll 570 may be stored and/or transported for later processing. Label web roll 570 may be further processed in other location. The apparatus of the FIG. 10 may further comprise a cooling cylinder 650.

The belt length, speed and/or temperature may influence the drying process of the water-based adhesive on the belt. The length of the belt may be at least 10 m, and not greater than 50 m. The speed of the belt may be 200-1200 m/min. Drying temperature of the water-based adhesive on a belt may be 80-85 degrees C. or even higher. Preferably the drying temperature is at least 75 degrees C. to ensure that the water-based adhesive becomes fully dried and provides maximum adhesive performance such as adhesion.

Figure 11:
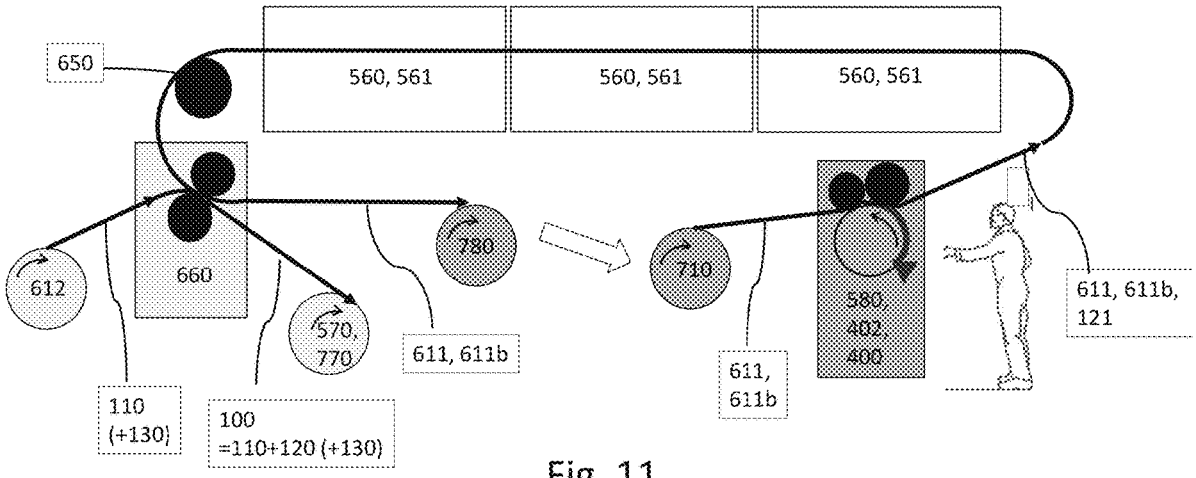
FIG. 11 illustrates, by way of an example, an embodiment of a manufacturing method and an apparatus.
Figure 12A:
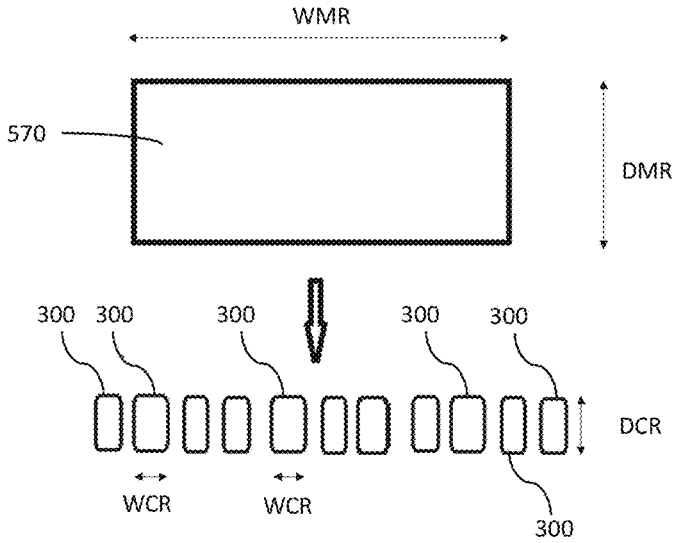
FIG. 12*a* illustrates, by a way of an example, some customer rolls obtained from a machine roll.
Figure 12B:
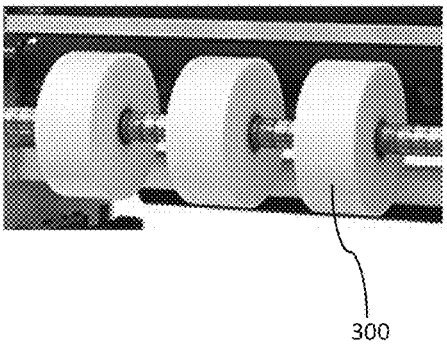
FIG. 12*b* illustrates, by a way of an example, some customer rolls obtained from a machine roll.

FIG. 11 illustrates schematically an alternative manufacturing method wherein instead of an endless belt, the carrier 611 is arranged to be a reusable batch of a web material 611*b*. This allows to run predetermined lengths of production as batches and reuse the carrier material several times. The benefits of this approach include, but are not limited to, possibility to use existing liner materials, for example siliconized PET liner as carrier.

In FIG. 11 the carrier 611, 611*b* is unwound at carrier unwinder 710 and guided to an adhesive coating station 580. The carrier is preferably a pre-siliconized carrier. The carrier 611*b* is forwarded through a drier or series of driers 560, 561. The face 110 is unwound at face unwinder 612 and in order to meet the carrier 611 in a nip arrangement 660 wherein the PSA 120 from the carrier 611 is transferred onto the face 110. After this transfer the face 110 together with the PSA 120 is rewound onto a machine roll using a linerless winder 770. The used carrier material 611, 611*b* wherefrom the PSA 120 has been removed is guided to a carrier rewinder 780. The carrier material is reusable and may be transferred back to unwinder 710 for reuse. The apparatus of the FIG. 11 may further comprise a cooling cylinder 650. The cooling cylinder may be situated before the point wherein the dried water-based adhesive (PSA) is attached to the face 110.

It should be understood that all heating/drying methods explained earlier with respect to the endless belt embodiment in FIG. 10 are also applicable herein if they are suitable for the reusable batch carrier selected to be used. It should also be understood that all adhesive coating methods explained earlier in this specification are also applicable herein. A preferable coating method(s) are explained in more detail in this specification.

Thus, as disclosed in this application, the adhesive coating 121 is arranged to be in a shape of positionally alternating adhesive stripes. This means that the adhesive coating can be coated onto the carrier material 611, 611*a*, 611*b* in continuous, positionally alternating, parallel stripes running in machine direction, i.e. in longitudinal direction of the carrier. The positionally alternating adhesive stripe(s) may be obtained e.g. by using any of the above discussed methods.

Referring back to FIG. 4*a* in view of FIGS. 5-8, it is possible that steps 401-405 may take place in various order. Further, referring back to FIG. 4*b* in view of 10 to 11, it is possible that steps 402 to 407 may take place in various order.

Thanks to the present invention, many advantages may be obtained. Particularly, telescoping problem of the machine rolls may be prevented. Further, telescoping problem of the customer rolls may be prevented. Still further, easiness and controllability of the manufacturing process of the linerless label may be improved.

In addition to the above-mentioned advantages, at least some of the following advantages may further be obtained:

1) Reliable adhesion/tackiness of the adhesive may be obtained for all of those different types of surfaces onto which the label will be manually dispensed or applied, e.g. during the preparation of the order (for example in the kitchen) or when labelling the various items of the order (for example cups, boxes, wraps, bags, or other packages).
2) Easy repositionability may be obtained so that the label is first applied onto a first surface and then repositioned onto another surface. For example, label may be used first in the kitchen as a note and then labelled onto the ready-made dish.
3) Easy removability may be obtained, for example for customers removing the label used as a closure or seal for a package.
4) Permanent final tack of the label may be achieved in applications where lower first tack is beneficial to reduce adhesive build up in the printer but permanent type of tack of label is preferred after dispensing on the item to be labelled.
5) Suitable chemistry either for direct or indirect food contact may be obtained.
6) Sustainability supporting the short life of such labels may be obtained, i.e. chemistry which does not create undue burden to the environment or call for any special waste management procedures compared to other waste that becomes generated in the processes and activities where such labels are used.
7) Water-based acrylic PSA may provide further benefits, such as better sustainability with less fossil based raw materials and less volatiles involved both during the manufacturing and during end use.

EXPERIMENTAL TESTS

Example 1

Reference machine rolls comprising adhesive stripes without positionally alternating continuous adhesive stripes, and novel rolls comprising positionally alternating adhesive stripes were manufactured.

The reference rolls comprised adhesive stripes having adhesive-free areas between the adhesive strips. The width of the adhesive stripes was substantially same as the width of the adhesive-free areas.

The novel rolls comprised positionally alternating adhesive stripes comprising the same width of the adhesive-free areas, and the same width of the adhesive stripes, as the reference rolls. An amplitude of the positionally alternating adhesive stripes was 25 mm. Frequency of the actuator during the manufacturing step of the positionally alternating adhesive stripes was 1 Hz. A driving speed of the web was of approximately 200 m/60 seconds, hence moving a few meters per second.

The machine rolls were slitted by using a slitting machine. A width and a length of each customer roll was varied during the testing.

The reference machine rolls had significant telescoping problem in the order of several centimeters or even more, affecting the slitting process. The telescoping was also seen in customer rolls having a great length.

The novel machine rolls as well as the novel customer rolls had smooth outer surface. Further the slitting process was easy, without any specific adjustment.

Figure 9B:
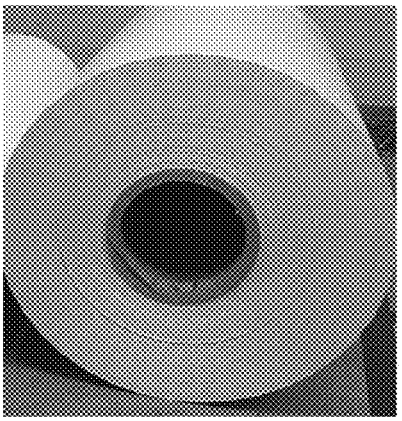
FIG. 9*b* shows a photo from experimental tests.

Some photos from the experimental tests are shown in FIGS. 9*a-b*, wherein FIG. 9*a* shows an example of a reference roll having a width of 5 mm of stripes and adhesive-free areas, and FIG. 9*b* shows an example of a novel roll having the same width of the stripes and the adhesive-free areas but comprising positionally alternating continuous adhesive stripes.

The invention is not limited solely to the examples presented in Figures and the above description, but it may be modified within the scope of the appended claims.

The invention claimed is:

1. A linerless customer roll (300) manufactured from a continuous linerless label web (100), which said linerless label web (100) has been arranged to be self-wound into a linerless machine roll (570), then said machine roll (570) has been arranged to be unwound and lengthwise slit and cut into narrower customer web lengths having a predetermined length and width, after which said customer web lengths has been self-wound into a number of linerless customer rolls, wherein the linerless customer roll (300) comprises the narrower customer web comprising a face (110) having a first side (111) and a second side (112) and positionally alternating continuous adhesive stripes (121) on the second side (112) of the web with predetermined number of the stripes (A) in cross-direction of the web, predetermined width of the stripes (B) in the cross-direction of the web, predetermined positional frequency (C) of the stripes in the lengthwise direction of the web, and predetermined positional amplitude (D) of the stripes in the cross-direction of the web wherein said predetermined properties (A,B,C,D) of the positionally alternating continuous adhesive stripes (121) are selected so that number of the stripes in the linerless customer roll (300) is one or more, width of the stripes is smaller than width of the linerless customer roll (300), and positional frequency is selected so that one oscillation cycle covers 5-90 peripherical lengths in the customer roll (300) defined as peripheries of a full customer roll (300);

wherein each customer roll has a diameter of 50 to 150 mm, defined as a diameter of the full customer roll (300); and wherein the customer roll (300) does not exhibit telescoping.

2. The linerless customer roll according to claim 1, wherein the one or more than one positionally alternating adhesive stripe has a positional amplitude in a range of 0.1-1 times the width of the customer roll (300).

3. The linerless customer roll according to claim 1, wherein positional frequency of the adhesive stripe is selected so that one oscillation cycle covers equal to or more than 10 peripherical lengths in the customer roll (300), defined as peripheries of the full customer roll (300), and one oscillation cycle covers equal to or less than 70 peripherical lengths in the customer roll (300), defined as peripheries of the full customer roll (300).

4. The linerless customer roll according to claim 1, wherein the one or more than one positionally alternating adhesive stripe has a positional wavelength (WL) in a range between 0.5 m and 10 m.

5. The linerless customer roll according to claim 1, wherein the width of at least one of said one or more than one adhesive stripe is smaller than the positional amplitude of said at least one adhesive stripe.

6. The linerless customer roll according to claim 1, wherein the pressure sensitive adhesive coating (120) comprises water-based acrylic adhesive.

7. The linerless customer roll according to claim 1, wherein the linerless label web consists of the face (110), the one or more than one positionally alternating adhesive stripe on the second side of the face, and the release coating (130) on the first side of the face.

8. The linerless customer roll according to claim 1, wherein total coverage of the adhesive coating is equal to or less than 50% calculated from the total area of the second side (112) of the face, and/or total coverage of the adhesive coating is equal to or more than 10%, calculated from the total area of the second side (112) of the face.

9. A method for manufacturing a continuous linerless label web (100), said label web (100) arranged to be self-wound into a linerless machine roll (570) and said machine roll (570) later arranged to be unwound and lengthwise slit and cut into narrower customer web lengths having a predetermined length and width, which customer web lengths are later arranged to be self-wound into a number of linerless customer rolls (300), the continuous linerless label web (100) comprising a face (110) having a first side (111) and a second side (112) and a positionally alternating adhesive coating on the second side (112), wherein the method comprises supplying the face (110) with a release coating arranged on the first side (111), providing positionally alternating continuous adhesive stripes (121) on the second side (112) of the web (100) with predetermined number of the stripes (A) in cross-direction of the web (100), predetermined width of the stripes (B) in the cross-direction of the web (100), predetermined positional frequency (C) of the stripes in the lengthwise direction of the web (100), and predetermined positional amplitude (D) of the stripes in the cross-direction of the web (100)

wherein said predetermined properties (A,B,C,D) of the positionally alternating continuous adhesive stripes (121) are selected so that number of stripes in each single customer roll (300) is one or more, width of each stripe is smaller than width of single customer roll (300), and positional frequency is selected so that one oscillation cycle covers 0.1-10 peripherical lengths in a machine roll (570), and 5-90 peripherical lengths in a customer roll (300) defined as peripheries of full customer rolls;

wherein each customer roll has a diameter of 50 to 150 mm, defined as a diameter of the full customer roll (300); and wherein the customer roll does not exhibit telescoping;

wherein the step of providing one or more than one positionally alternating adhesive stripe comprises:

applying an adhesive on to the face by using an oscillating actuator, and thermally drying the adhesive (121) into a pressure sensitive adhesive (120) on the face, or applying the adhesive onto the carrier material (611) by using an oscillating actuator, thermally drying the adhesive (121) into the pressure sensitive adhesive (120) on the carrier material, and transferring the pressure sensitive adhesive onto the face.

10. The method according to claim 9, wherein the oscillating actuator comprises an oscillating nozzle.

11. The method according to claim 9, wherein the step of providing the one or more than one positionally alternating adhesive stripe comprises:

applying a continuous layer of adhesive, removing at least 50% of the adhesive coating (121) prior to drying by using an oscillating actuator (400) in order to obtain the one or more than one positionally alternating adhesive stripe.

12. The method according to claim 11, wherein the oscillating actuator comprises a blade.

13. The method according to claim 9, wherein the positional frequency of the adhesive stripe is selected so that one oscillation cycle covers equal to or more 0.4 peripherical lengths in the machine roll, defined as peripheries of the full machine roll, and/or one oscillation cycle covers equal to or less 6 peripherical lengths in the machine roll, defined as peripheries of the full machine roll.

14. The method according to claim 9, wherein the one or more than one positionally alternating adhesive stripe has a positional amplitude in a range of 0.1-1 times the width of the customer roll (300).

15. The method according to claim 9, wherein positional frequency of the adhesive stripe is selected so that one oscillation cycle covers equal to or more than 10 peripherical lengths in the customer roll (300), defined as peripheries of the full customer roll (300), and one oscillation cycle covers equal to or less than 70 peripherical lengths in the customer roll (300), defined as peripheries of the full customer roll (300).

16. The method according to claim 9, wherein the one or more than one positionally alternating adhesive stripe has a positional wavelength (WL) in a range between 0.5 m and 10 m.

17. The method according to claim 9, wherein the width of at least one of said one or more than one adhesive stripe is smaller than the positional amplitude of said at least one adhesive stripe.

18. The method according to claim 9, wherein the pressure sensitive adhesive coating (120) comprises water-based acrylic adhesive.

19. The method according to claim 9, wherein the linerless label web consists of the face (110), the one or more than one positionally alternating adhesive stripe on the second side of the face, and the release coating (130) on the first side of the face.

20. The method according to claim 9, wherein total coverage of the adhesive coating is equal to or less than 50% calculated from the total area of the second side (112) of the face, and/or total coverage of the adhesive coating is equal to or more than 10%, calculated from the total area of the second side (112) of the face.

* * * * *